US011700911B2

(12) United States Patent
Nakaya et al.

(10) Patent No.: US 11,700,911 B2
(45) Date of Patent: Jul. 18, 2023

(54) SHOE SOLE INCLUDING LAMINATE-STRUCTURED MIDSOLE

(71) Applicant: ASICS CORPORATION, Kobe (JP)

(72) Inventors: Seigo Nakaya, Kobe (JP); Kenta Moriyasu, Kobe (JP); Yoshihito Tahira, Kobe (JP); Keishi Kitamoto, Kobe (JP); Junichiro Tateishi, Kobe (JP)

(73) Assignee: ASICS CORPORATION, Kobe (JP)

( * ) Notice: Subject to any disclaimer, the term of this patent is extended or adjusted under 35 U.S.C. 154(b) by 200 days.

(21) Appl. No.: 17/052,123

(22) PCT Filed: May 18, 2018

(86) PCT No.: PCT/JP2018/019289
§ 371 (c)(1),
(2) Date: Oct. 30, 2020

(87) PCT Pub. No.: WO2019/220621
PCT Pub. Date: Nov. 21, 2019

(65) Prior Publication Data

US 2021/0227927 A1 Jul. 29, 2021

(51) Int. Cl.
*A43B 13/12* (2006.01)
*A43B 13/04* (2006.01)
*A43B 13/18* (2006.01)

(52) U.S. Cl.
CPC ..... *A43B 13/127* (2013.01); *A43B 13/04* (2013.01); *A43B 13/186* (2013.01); *A43B 13/188* (2013.01)

(58) Field of Classification Search
CPC ... A43B 13/127; A43B 13/186; A43B 13/188; A43B 13/04; A43B 13/16; A43B 13/125
See application file for complete search history.

(56) References Cited

U.S. PATENT DOCUMENTS 8,220,186 B2 * 7/2012 Nomi ..... A43B 13/36 36/105
2009/0019730 A1 * 1/2009 Salminen ..... A43B 7/1425 36/102

(Continued)

FOREIGN PATENT DOCUMENTS

EP 0 092 366 A1 10/1983
JP S58-190401 A 11/1983

(Continued)

OTHER PUBLICATIONS

International Search Report issued in PCT/JP2018/019289; dated Aug. 21, 2018.

*Primary Examiner* — Khoa D Huynh
*Assistant Examiner* — Haley A Smith
(74) *Attorney, Agent, or Firm* — Studebaker & Brackett PC

(57) ABSTRACT

A midsole includes an upper layer and a lower layer made of a foamed material; the upper layer is a low-hardness foamed material; the lower layer is a high-hardness foamed material; the low-hardness foamed material of the upper layer is a low-hardness, high-resilience material that has a higher specific gravity than the high-hardness foamed material, that has a low hardness that is lower than the hardness of the high-hardness foamed material, and that has a higher speed at which to recover to an original shape after being deformed than that of the high-hardness foamed material.

17 Claims, 14 Drawing Sheets

(56) References Cited

U.S. PATENT DOCUMENTS

| | | | | |
|---|---|---|---|---|
| 2010/0218399 | A1 | 9/2010 | Jeong | |
| 2010/0288435 | A1* | 11/2010 | D'herbecourt | B32B 38/162 156/272.6 |
| 2011/0185590 | A1* | 8/2011 | Nishiwaki | A43B 13/187 36/28 |
| 2011/0197469 | A1* | 8/2011 | Nishiwaki | A43B 13/186 36/28 |
| 2013/0074371 | A1* | 3/2013 | Borel | A43B 7/142 36/102 |
| 2015/0135558 | A1* | 5/2015 | Inomata | A43B 13/14 36/25 R |
| 2015/0272269 | A1* | 10/2015 | Niskanen | A43B 7/144 36/30 R |
| 2016/0015122 | A1* | 1/2016 | Nishiwaki | A43B 13/42 36/30 R |
| 2019/0231026 | A1 | 8/2019 | Fujita et al. | |
| 2020/0022452 | A1 | 1/2020 | Hatano et al. | |

FOREIGN PATENT DOCUMENTS

| | | | |
|---|---|---|---|
| JP | H11-28105 | A | 2/1999 |
| JP | 2002-291501 | A | 10/2002 |
| JP | 2004-313774 | A | 11/2004 |
| JP | 2010-525917 | A | 7/2010 |
| JP | 2016-027929 | A | 2/2016 |
| JP | 3213557 | U | 11/2017 |

* cited by examiner

SHOE SOLE INCLUDING LAMINATE-STRUCTURED MIDSOLE

TECHNICAL FIELD

The present invention relates to a shoe sole having a midsole of a layered structure (a laminate-structured midsole).

BACKGROUND ART

It is known in the art to use a midsole having two layers of different hardnesses.

CITATION LIST

Patent Literature

First Patent Document: U.S. Pat. No. 9,763,493 B2 (front page)

This conventional technique discloses using a low-hardness, low-resilience foamed material.

SUMMARY OF INVENTION

However, the conventional technique has no disclosure as to employing a high-resilience foamed material.

There appears to have been no conventional examples that studied the relationship between the layered structure of the midsole and the ankle angle and the ankle angular velocity in an attempt to reduce the load on muscles and tendons.

Thus, a principle object of the present invention is to reduce the load on muscles and tendons while running by using a midsole of a layered structure using a high-resilience foamed material.

Principles of the Invention

Next, prior to the description of the structure of the present invention, the principles of the present invention will be described.

FIG. 11 shows the foot bone structure. MP is the metatarsal phalangeal joint.

FIGS. 12(*a*) to 12(*e*) are side views showing the wearer while running, wherein FIG. 12(*a*) shows a state (so-called "heel contact") where the foot first lands with the rear end of the heel in contact with the ground, FIG. 12(*b*) shows a state (so-called "foot flat") where the entire sole of the foot is generally in contact with the ground, FIG. 12(*c*) shows a state (so-called "mid stance") immediately before the foot starts to kick off, FIG. 12(*d*) shows a state (so-called "heel rise") where the foot has kicked off with the heel raised, and FIG. 12(*e*) shows a state (so-called "toe off") immediately before the toes of the foot take off. FIGS. 12(*f*) and 12(*g*) show the change in the shape of the ankle (the ankle joint) and the foot from mid stance to heel rise. FIG. 12(*f*) shows the ankle dorsiflexed, and FIG. 12(*g*) shows the ankle plantarflexed. FIGS. 12(*h*) to 12(*g*) are side views of the ankle and the foot showing angles α, β and γ.

The present inventor made the following assumptions regarding the reduction of the load on muscles and tendons.

Mechanism for Reducing Load on Calf at Mid Stance

At mid stance of FIG. 12(*c*), the load from the foot to the sole acts while being centered at the MP joint. Then, with an ordinary foamed material sole, since the amount of compressive deformation of the forefoot portion is larger than that of the rear foot portion, the foot at mid stance is likely to be in such a position that the toes are lower than the heel.

On the other hand, when the compressive rigidity of the foamed material sole of the forefoot portion is lower than that of the foamed material sole arranged in the heel, the amount of compressive deformation of the forefoot portion increases as compared with the ordinary foamed material sole described above, thereby increasing the foot angle β of FIG. 12(*i*). Then, since the change in the lower leg angle γ of FIG. 12(*j*) is smaller than the foot angle β, the ankle angle α of FIG. 12(*h*) increases.

Now, following the change in the ankle angle α, the lengths of calf muscles and tendons (Achilles tendon) change. That is, the muscles and tendons extend as the angle α decreases, and the tension of the muscles and tendons relaxes as the angle α increases. By arranging a thick layer of a low-hardness foamed material in the forefoot portion, the amount of compressive deformation of the forefoot portion at mid stance increases, thereby increasing the angle α. With this, the amount of extension of the calf muscles and the Achilles tendon decreases, thereby reducing the load on the muscles and the tendon.

Mechanism for Reducing Load on Calf at Kick Off

At heel rise of FIG. 12(*d*), the heel rises as shown in FIG. 12(*g*), thereby dorsiflexing the MP joint and plantarflexing the ankle. Then, if the amount of compressive deformation of the sole at the MP joint is large, thereby making the sole thin and decreasing the sole flexural rigidity, the dorsiflexion of the MP joint is increased and the height of the center of gravity of the body is lowered. The ankle angle α increases in order to avoid the lowering of the height of the center of gravity of the body.

On the other hand, with a high-resilience foamed material arranged in the forefoot portion, when the MP joint dorsiflexes, thereby compressing the sole, the high-resilience foamed material having a high recovery speed quickly returns to its original thickness. When the thickness of the sole quickly returns to the original thickness, the flexural rigidity of the sole increases, thereby decreasing the amount of flexural deformation of the sole at the MP joint, and the foot pivots forward while the dorsiflexion angle at the MP joint remains small. Thus, the change of the ankle angle α, i.e., the ankle angular velocity, is small.

On the other hand, the planter/dorsiflexion power of the ankle is calculated as the product between the ankle torque and the angular velocity. Therefore, the planter/dorsiflexion power of the ankle decreases as the angular velocity decreases. That is, the load on calf muscles is reduced when the propulsion is generated upon kick off.

The present invention is a shoe sole including an outsole 4 having a tread surface 4*s*, and a midsole 3 arranged on the outsole 4, wherein:

the midsole 3 includes an upper layer 2 and a lower layer 1 each of a foamed material;

the upper layer 2 is a low-hardness foamed material H having a thermoplastic resin component;

the lower layer 1 is a high-hardness foamed material N that has a thermoplastic resin component and has a high hardness that is higher than a hardness of the low-hardness foamed material H;

the upper layer 2 is seamlessly and integrally continuous from a posterior end portion Rx of a rear foot portion R to an anterior end portion Ff of a forefoot portion F;

the lower layer 1 is seamlessly and integrally continuous from the posterior end portion Rr of the rear foot portion R to a posterior end portion Fr of the forefoot portion F;

a boundary line L, which is a line of an anterior end of the lower layer 1 and is an anterior-posterior boundary between the upper layer 2 and the lower layer 1, is arranged at the posterior end portion Fr of the forefoot portion F;

in the forefoot portion F, a lower surface 2*s* of the upper layer 2 includes a primary (main) tread portion 30 between a medial edge portion ME and a lateral edge portion LE of the midsole 3, and a line of a posterior end of the primary tread portion 30 is defined by the boundary line L;

in the primary tread portion 30 of the forefoot portion F anterior D1 to the boundary line L, an upper surface 4*f* of the outsole 4 is attached to the lower surface 2*s* of the upper layer 2; and the low-hardness foamed material H of the upper layer 2 is a low-hardness, high-resilience material that has a higher specific gravity than the high-hardness foamed material N, that has a low hardness that is lower than the hardness of the high-hardness foamed material N, and that has a higher speed at which to recover to an original shape after being deformed than that of the high-hardness foamed material N.

As shown in FIGS. 12(*a*) to 12(*e*), the foot lands from the posterior end of the heel, and the entire sole of the foot gradually comes into contact with the ground, after which the foot takes off with the toes kicking off the road surface.

Now, upon heel contact (FIG. 12(*a*)), the heel of the foot receives a significant shock called the 1st strike. For this, with the present structure, the high-hardness foamed material N arranged on the lower layer 1 of the posterior end portion Rr of the rear foot portion R will exhibit a relatively large compressive deformation and absorb part of the shock, while the low-hardness foamed material H arranged on the upper layer 2 of the posterior end portion Rr of the rear foot portion R will fit to the shape of the heel and disperse the shock transmitted to the bottom of the heel.

Therefore, the shock of the 1st strike will be absorbed.

The foot is likely to pronate and supinate from heel contact (FIG. 12(*a*)) to mid stance (FIG. 12(*c*)). For this, with the present structure, on the lower layer 1, the high-hardness foamed material N is seamlessly and integrally continuous from the rear foot portion R to the posterior end portion Fr of the forefoot portion F, and thus suppresses excessive deformation of the middle foot portion of the midsole. Therefore, the pronation and the supination can be suppressed.

On the other hand, with the present structure, on the upper layer 2, the low-hardness foamed material H is seamlessly and integrally continuous from the rear foot portion R to the forefoot portion F, and it is therefore possible to suppress the upthrust against the sole of the foot in the arch portion.

At mid stance of FIG. 12(*c*), the load from the foot to the sole acts while being centered at the MP joint. Then, the amount of compressive deformation of the forefoot portion F of the sole is larger than that of the rear foot portion R. Therefore, the foot at mid stance is in such a position that the toes are lower than the heel.

On the other hand, with the present structure, the high-hardness foamed material N is not arranged and the low-hardness foamed material H having a low compressive rigidity is arranged in the primary tread portion 30 of the forefoot portion F, and therefore the amount of compressive deformation of the forefoot portion increases as compared with an ordinary foamed material sole, increasing the foot angle β of FIG. 12(*i*). Then, since the change in the lower leg angle γ of FIG. 12(*j*) is smaller as compared with the foot angle β, the ankle angle α of FIG. 12(*h*) increases.

Now, the tension of the muscles and tendons relaxes as the angle α increases, as described above. With the present structure where the high-hardness foamed material N is not arranged in the primary tread portion 30, the low-hardness foamed material H can be formed to be thick in the primary tread portion 30, and therefore the amount of compressive deformation of the primary tread portion 30 at mid stance is large. Thus, the amount of extension of the calf muscles and the Achilles tendon will decrease as the angle α increases, thereby reducing the load on these muscles and tendons.

At heel rise of FIG. 12(*d*) and toe off of FIG. 12(*e*), the heel rises, thereby dorsiflexing the MP joint and plantarflexing the ankle JF.

With the present structure, since the high-resilience, low-hardness foamed material H is arranged in the forefoot portion F, when the MP joint dorsiflexes to compress the sole, the high-resilience, low-hardness foamed material H having a high recovery speed quickly returns to its original thickness. With the thickness of the sole quickly returning to its original thickness, the flexural rigidity of the sole increases. That is, since the flexural rigidity of the sole is in proportion to the thickness of the sole cubed, the amount of flexural deformation of the sole at the MP joint decreases because of the thick forefoot portion F, and the foot pivots forward while the dorsiflexion angle at the MP joint remains small. Thus, the change of the ankle angle α, i.e., the ankle angular velocity, will be small.

As described above, the planter/dorsiflexion power of the ankle is calculated as the product between the ankle torque and the angular velocity. Therefore, the planter/dorsiflexion power of the ankle decreases as the angular velocity decreases. That is, the load on calf muscles will be reduced when the propulsion is generated upon heel rise, etc.

The present invention should be understood through these advantages of the present structure.

For example, the primary tread portion 30 where the high-hardness foamed material N is not arranged and the low-hardness foamed material H is arranged refers to an area of the midsole where there is a high load applied from the tread portion of the foot to the midsole 3 from mid stance to toe off.

Therefore, the line of the posterior end of the primary tread portion 30, which defines the area of the primary tread portion 30 in the front-rear direction, i.e., the boundary line L, is preferably arranged posterior to a position that corresponds to the MP joint.

In the present invention, the upper layer 2 being seamlessly and integrally continuous from the posterior end portion Rr of the rear foot portion R to the anterior end portion Ff of the forefoot portion F means that the upper layer 2 extends from the anterior end of the rear foot portion R toward a position that is posterior to a half of the rear foot portion R, and the upper layer 2 extends from the posterior end of the forefoot portion F toward a position that is anterior to a half of the forefoot portion F.

The boundary line L being arranged at the posterior end portion Fr of the forefoot portion F means that the boundary line L is arranged in an area that extends from the posterior end of the forefoot portion F to within a half of the forefoot portion F, and it preferably means that the boundary line L is arranged posterior to a position that corresponds to the ball of the big toe or the MP joint.

Where a bent groove extending in the width direction over more than a half of the width of the midsole 3 is provided in an area of the midsole and the outsole that corresponds to the MP joint, the boundary line L is preferably arranged posterior to the bent groove.

In the forefoot portion F of the midsole 3, the medial edge portion ME and the lateral edge portion LE are portions that suppress the collapse of the sole of the foot in the width direction, and no primary load is applied to these portions. On the other hand, in the forefoot portion F of the midsole 3, the primary tread portion 30 between the medial edge portion ME and the lateral edge portion LE corresponds to the MP joint of the first to third toes, and therefore a large load will be applied to the primary tread portion 30.

In the present invention, the width of the primary tread portion 30 is preferably larger than the sum of the width of the medial edge portion ME and the width of the lateral edge portion LE. That is, the width of the primary tread portion 30 is preferably larger than more than a half of the width of the midsole 3. For example, it is preferred that the lower layer 1 is not arranged and the lower surface 2s of the upper layer 2 forms the primary tread portion 30 in the central area excluding the medial edge portion ME (which is ¼ of the width of the forefoot portion F from the medial edge of the forefoot portion F) and the lateral edge portion LE (which is ¼ of the width of the forefoot portion F from the lateral edge of the forefoot portion F).

In the present invention, preferably, the lower layer 1 forms a longitudinal arch 1A extending in a front-rear direction D at least on a medial side, wherein the longitudinal arch 1A has a lower surface that is depressed facing downward;

an area that is anterior to the longitudinal arch 1A comprises the forefoot portion F;

an area that is posterior to the longitudinal arch 1A comprises the rear foot portion R; and an area where the longitudinal arch 1A is provided comprises a middle foot portion M between the forefoot portion F and the rear foot portion R.

In this case, the boundary line L will be arranged between the longitudinal arch 1A and the bent groove.

Now, in the present invention, the high-resilience, low-hardness foamed material H (high resilience) of the upper layer 2 is defined based on the specific gravity, the hardness and the recovery speed relative to those of the ordinary high-hardness foamed material N (normal) of the lower layer 1.

Typically, the resilience property of a foamed material is often defined based on the ratio tan δ between the storage elastic modulus and the loss elastic modulus. However, it is difficult to cut out a test piece from an actual product to measure the elastic moduli.

On the other hand, the high-resilience material has a higher specific gravity and a higher recovery speed as compared with common foamed materials for midsoles. These physical quantities are much easier to measure than the elastic moduli.

In view of this, according to the present invention, the high-resilience material is defined based on the specific gravity and the recovery speed.

It is typically preferred that the Young's modulus of an unfoamed/unformed high-resilience material is 10 to 200 MPa.

Using a material of which the δ above, i.e., the loss factor 6, is small, the recovery speed, which is a resilience property, increases. The tan δ described above of the high-resilience material at a frequency of 10 Hz and at 23° C. is preferably 0.1 or less, even more preferably 0.08 or less, and most preferably 0.06 or less.

The storage elastic modulus of an unfoamed forming material of the high-hardness foamed material N (normal) at a frequency of 10 Hz and at 23° C. is smaller than that of the low-hardness foamed material H, and is typically 20 MPa or more, preferably 30 to 300 MPa, and more preferably 40 to 200 MPa. The high-hardness foamed material N obtained by foaming a forming material having such a storage elastic modulus has a good stability and a good cushioning property.

Although there is no particular limitation, the foaming ratio of the high-resilience material is preferably 2 to 200 or more, and more preferably 3 to 100. The foaming ratio is determined by dividing the unfoamed density by the foamed density.

In order to achieve a lighter weight, the specific gravity of the high-resilience, low-hardness foamed material H is preferably 0.3 or less, more preferably 0.28 or less, and even more preferably 0.26 or less. The specific gravity of the high-resilience material is preferably 0.05 or more, and more preferably 0.10 or more, for example.

Although there is no particular limitation, the foaming ratio of the high-hardness foamed material N (normal) is preferably 2 to 200, and more preferably 3 to 100.

In order to achieve a lighter weight, the specific gravity of the high-hardness foamed material N is preferably 0.25 or less, more preferably 0.22 or less, and even more preferably 0.20 or less. The specific gravity of the high-hardness foamed material N is preferably 0.05 or more, and more preferably 0.10 or more, for example.

The high-hardness foamed material N (normal) and the low-hardness foamed material H each include a thermoplastic resin component and any other suitable component. Examples of the thermoplastic resin component include, for example, a thermoplastic elastomer and a thermoplastic resin.

The type of the thermoplastic elastomer may be, for example, a styrene-based elastomer such as a styrene ethylene butylene styrene block copolymer (SEBS), an ethylene-vinyl acetate copolymer-based elastomer, a polyolefin-based elastomer, a polyamide-based elastomer, a polyester-based elastomer, a polyurethane-based elastomer, etc.

The type of the thermoplastic resin may be, for example, polyethylene (PE), a vinyl acetate-based resin such as an ethylene-vinyl acetate copolymer (EVA), polystyrene, a styrene butadiene resin, etc.

One of the resin components mentioned above may be used alone or two or more of them may be used in combination.

The outsole is a tread sole having a greater abrasion resistance than the midsole, and typically has a higher hardness and a higher recovering speed than the high-hardness foamed material N (normal) of the midsole. The outsole is typically a foamed rubber material or a non-foamed rubber or urethane material.

While any of various resins may be employed as the raw material of the high-hardness foamed material N (normal) of the present invention, a foamed EVA material used in an ordinary midsole may be employed, for example. As a method for increasing the hardness of the high-hardness foamed material N, a filler is added, for example. The filler may be spherical particles, fibrous powder or flaky powder.

On the other hand, the low-hardness foamed material H, which is the high-resilience material of the present invention, may be a similar EVA to the high-hardness foamed material N, for example, and in order to achieve a high resilience, the loss factor 6 of the forming material is set to be smaller than that of the high-hardness foamed material N.

As a method for decreasing the hardness of the low-hardness foamed material H, the amount of a plasticizer to be added may be increased, for example.

The specific gravity of the low-hardness foamed material H, which is a high-resilience material, is set to be high for the following reason. Since the material selected itself has a relatively low strength, the ratio of the resin part relative to the voids generated through foaming is increased, thereby increasing the specific gravity, so as to increase the strength and the endurance of the low-hardness foamed material H.

The high-resilience, low-hardness foamed material H whose specific gravity is high has a greater inter-bubble distance and a larger bubble wall thickness than the inter-bubble distance of the high-hardness foamed material N (normal). Thus, the resin structure (bubble wall) is unlikely to buckle, and the increase in load and the increase in distortion are likely to be in proportion to each other. That is, a high-resilience material has a high specific gravity, but the linearity of change is strong. Therefore, a high-resilience material can be employed even if it is a foamed material of a relatively low hardness.

On the other hand, the high-hardness foamed material N (normal) whose specific gravity is low has a smaller inter-bubble distance and a smaller bubble wall thickness than the low-hardness foamed material H. Therefore, it exhibits linearity under a small load that is less than or equal to a certain load, but it is believed that the resin structure (bubble wall) buckles when under a load that is greater than or equal to a certain load. Thus, there exists a stress range where the distortion increases rapidly for a small load increase. Therefore, the high-hardness foamed material N is a foamed material that easily absorbs the shock.

Note that the specific gravity of a foamed material, as used herein, refers to the weight per unit volume.

In the present invention, the hardness of a foamed material may be a value that is measured with an Asker C hardness tester (JIS K6301C hardness tester). While the compressive rigidity EIz of a foamed material is in proportion to the Young's modulus E, it may be impossible or difficult to cut out a test piece from a foamed material to measure the Young's modulus E. Therefore, the relationship between properties of different foamed materials was defined based on hardness, which is easier to measure than the Young's modulus and has a positive correlation with the Young's modulus.

BRIEF DESCRIPTION OF DRAWINGS

In FIG. 13B, the longitudinal arch is dotted.

DESCRIPTION OF EMBODIMENTS

Figure 1A:
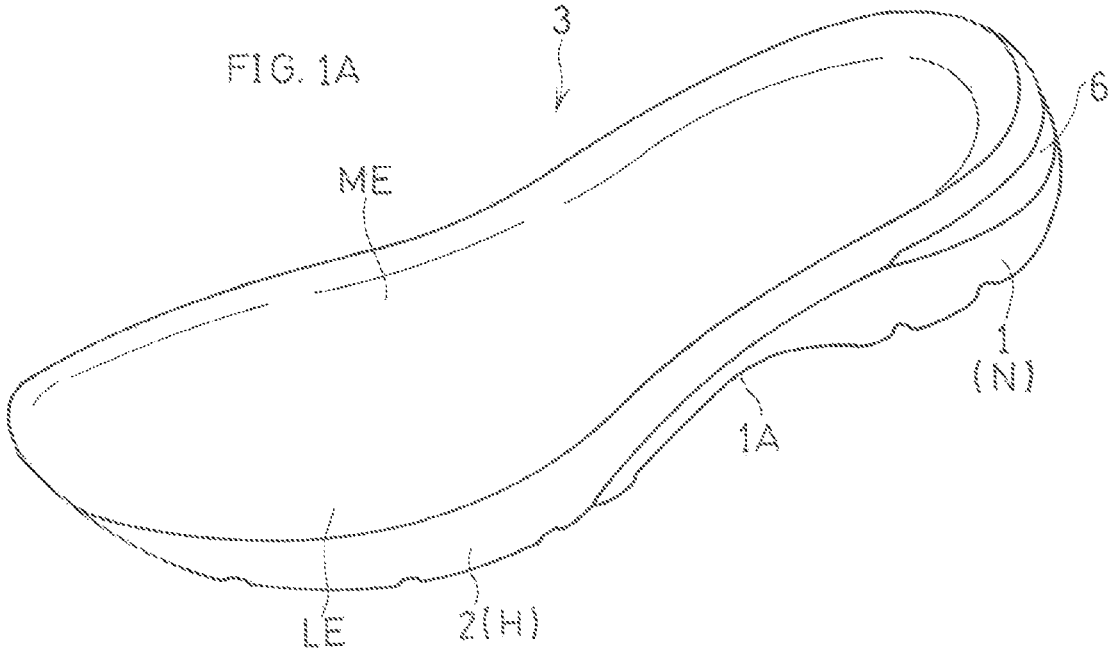
FIG. 1A and FIG. 1B are schematic perspective views of a midsole according to Embodiment 1 of the present invention as seen from a diagonally upper direction and a diagonally lower direction, respectively. Note that in FIG. 1B, the longitudinal groove and the depressed portion are dotted.

Preferably, the upper layer 2 is formed to be thickest in an area that is anterior D1 to the boundary line L; and the lower layer 1 is formed to be thickest in an area that is posterior D2 to the longitudinal arch 1A.

In this case, the thick upper layer 2 of the high-resilience, low-hardness foamed material H will exhibit an even higher flexural rigidity in an area anterior D1 to the boundary line L, and will likely reduce the burden on the muscles, etc.

On the other hand, the thick lower layer 1 exhibits a greater shock-absorbing property in an area posterior D2 to the longitudinal arch 1A.

Preferably, the lower layer 1 extends to a position posterior D2 to the longitudinal arch 1A;

the boundary line L of the lower layer 1 is arranged anterior D1 to the longitudinal arch 1A; and the boundary line L is arranged posterior D2 to a bent groove G extending in a width direction W that is provided on the upper layer 2 of the forefoot portion F.

In this case, the arrangement is such that the MP joint corresponds to the primary tread portion 30, and will likely reduce the burden on the muscles, etc.

Preferably, in the forefoot portion F, an upper surface 4*f* of one part of the outsole 4 is attached to lower surfaces 1*s* and 2*s* so as to bridge between the lower surface 1*s* of an anterior edge region 1*f* of the lower layer 1 and the lower surface 2*s* of an area of the upper layer 2 that is adjacent to the anterior edge region 1*f* of the lower layer 1.

The midsole 3 transitions from two layers to one layer across the boundary line L, and the flexural rigidity of the midsole is likely to change significantly. With the part of the outsole arranged so as to bridge over the boundary line L, it will be possible to reduce the change in the flexural rigidity of the sole as a whole, and to prevent an awkward feel on the sole of the foot or bending of the midsole.

Preferably, directly above the longitudinal arch 1A, a joint surface between the upper layer 2 and the lower layer 1 forms a downward slope that slopes down in an anterior D1 direction.

In this case, the thickness of the high-hardness foamed material N of the lower layer 1 decreases gradually from the middle foot portion M to the forefoot portion F, whereas the thickness of the low-hardness foamed material H of the upper layer 2 increases gradually from the middle foot portion M to the forefoot portion F. Therefore, it is possible to suppress a rapid change in the thickness of each foamed material, and the flexural rigidity of the midsole changes gradually, so that smooth running can be expected.

Preferably, at least in the forefoot portion F, the lower layer 1 is divided into a medial portion 1M and a lateral portion 1L;

a first edge E1 on a central side of the lower layer 1 of the medial portion 1M and a second edge E2 on the central side of the lower layer 1 of the lateral portion 1L are spaced apart from each other in a width direction W; and the upper layer 2 is exposed uncovered by the lower layer 1 between the first edge E1 and the second edge E2.

In this case, also in the forefoot portion, it is possible to suppress a rapid change in the flexural rigidity of the midsole so that smooth running can be expected.

Preferably, the boundary line L extends in a diagonally posterior D2 direction from the medial portion 1M toward the lateral portion 1L.

In this case, the boundary line L extends along a line of the MP joint that extends in a diagonally posterior direction from the medial side toward the lateral side of the foot. Thus, the boundary line L extends along the bend line of the foot, and smooth bending of the MP joint can be expected.

Preferably, the boundary line L is configured so as to be arranged posterior D2 to an anterior end of a ball O of a big toe (a ball of a foot) of a wearer.

In these cases, the low-hardness foamed material H can be formed to be thick while the high-hardness foamed material N is not arranged at the anterior end of the ball O of the big toe or directly under the metatarsal phalangeal joint MP in the primary tread portion 30. Therefore, it will enhance the function of the high-resilience, low-hardness foamed material H of increasing the ankle angle α at mid stance and decreasing the angular velocity of the ankle angle α at kick off in the primary tread portion 30.

Preferably, the boundary line L extends to a medial-side edge of the midsole 3 in the posterior end portion Fr of the forefoot portion F, and extends to a lateral-side edge of the midsole 3 in the posterior end portion Fr of the forefoot portion F.

In this case, the high-resilience, low-hardness foamed material H is arranged to be thick not only in the primary tread portion 30 but over the entire width of the midsole including the medial edge portion ME and the lateral edge portion LE. Therefore, it will further enhance the function of increasing the ankle angle α and decreasing the angular velocity of the ankle angle α.

Preferably, the lower layer 1 includes a first protruding portion 15 that extends along the medial edge portion ME of the midsole 3 to a position anterior D1 to the posterior end portion Fr of the forefoot portion F, and a second protruding portion 16 that extends along the lateral edge portion LE of the midsole 3 to a position anterior D1 to the posterior end portion Fr of the forefoot portion F;

an inner edge 15*e* of the first protruding portion 15 on a central side and an inner edge 16*e* of the second protruding portion 16 on the central side are spaced apart from each other in a width direction W; and the primary tread portion 30 is arranged between the first protruding portion 15 and the second protruding portion 16, and the boundary line L, which defines a line of a posterior end of the primary tread portion 30, is arranged at the posterior end portion Fr of the forefoot portion F.

In this case, it is possible to suppress a rapid change in the flexural rigidity of the midsole in the forefoot portion F so that smooth running can be expected. The medial edge portion ME and the lateral edge portion LE of the forefoot portion F are both supported by the high-hardness foamed material N, and it is possible to suppress the collapse of the forefoot portion F in the medial and lateral directions of the foot, thus enhancing the stability.

Preferably, a first longitudinal groove G1 extending in a front-rear direction D is formed on the primary tread portion 30; and of the lower surface 2*s* of the primary tread portion 30 of the upper layer 2, a first lower surface 2*s* that is on a medial side relative to the first longitudinal groove G1 and a second lower surface 2*s* that is on a lateral side relative to the first longitudinal groove G1 are not covered by the lower layer 1, each form a lower surface of the midsole 3, and are attached to the upper surface 4*f* of the outsole 4.

More preferably, the primary tread portion 30 includes a first primary portion 31 between the first longitudinal groove G1 and the medial edge portion ME, and a second primary portion 32 between the first longitudinal groove G1 and the lateral edge portion LE.

In this case, the first and second lower surfaces 2*s* of the primary tread portion 30 are attached to the upper surface 4*f* of the outsole 4 both on the medial side and the lateral side of the first longitudinal groove G1 for controlling the load center of the foot. Therefore, the primary tread portion 30 can be formed to be thick on both sides of the upper layer 2 (the medial side and the lateral side) of the first longitudinal groove G1). Therefore, the function of increasing the ankle angle α and decreasing the angular velocity of the ankle angle α will likely be exhibited.

More preferably, a size of the first primary portion 31 in a width direction W is larger than that of the second primary portion 32.

In this case, the first primary portion 31, where the largest load is applied when the MP joint is bent, can be formed to be wide and thick.

More preferably, at least in the forefoot portion F, the lower layer 1 is divided into a medial portion 1M and a lateral portion 1L;

a first edge E1 on a central side of the lower layer 1 of the medial portion 1M and a second edge E2 on the central side of the lower layer 1 of the lateral portion 1L are spaced apart from each other in a width direction W;

at least in the medial portion 1M, the lower layer 1 forms a longitudinal arch 1A extending in the front-rear direction D, and the longitudinal arch 1A has a lower surface that is depressed facing downward;

the first edge E1 on the central side of the lower layer 1 of the medial portion 1M and the second edge E2 on the central side of the lower layer 1 of the lateral portion 1L define a narrow slit S extending in the front-rear direction D from the forefoot portion F to a position posterior D2 to the longitudinal arch 1A; and the upper layer 2 is exposed uncovered by the lower layer 1 through the slit S.

In this case, the slit S extending from the forefoot portion F to a position posterior D2 to the longitudinal arch 1A is formed on the lower layer 1, and only the upper layer 2 is formed to be thick between the medial portion 1M and the lateral portion 1L. Therefore, there is obtained a midsole that is hard on the medial side and the lateral side and soft in the center in the middle foot portion M.

Figure 12:
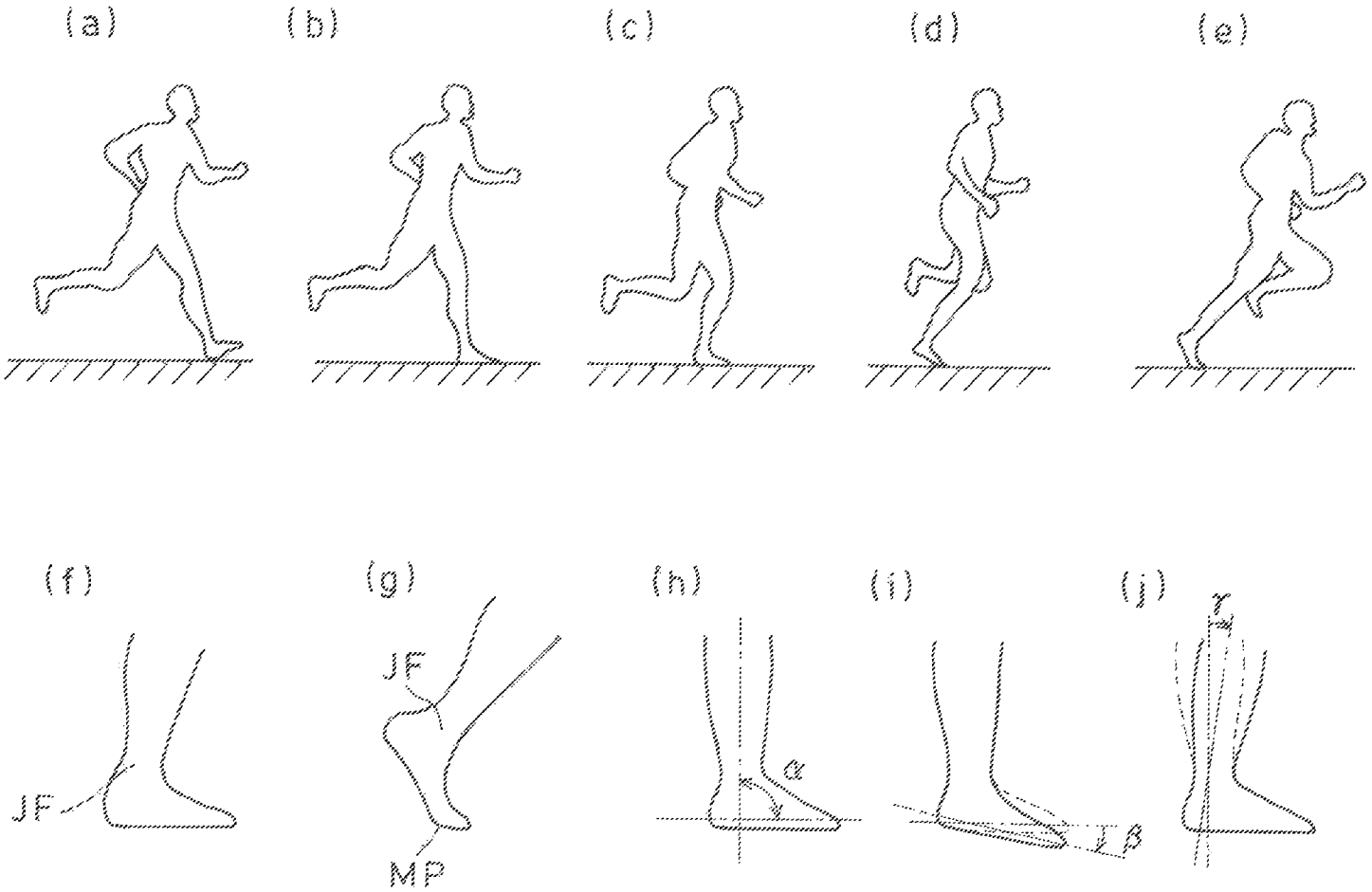
FIGS. 12(*a*) to 12(*j*) are side views showing the wearer, the lower leg and the foot.

Therefore, the high-hardness foamed material N on the medial side and the lateral side will suppress pronation and supination from foot flat of FIG. 12(*b*) to mid stance of FIG. 12(*c*).

On the other hand, the midsole includes a longitudinal flexible band-shaped portion along the slit S, and it will be easy to collapse downward along the flexible band-shaped portion. As a result, the foot is unlikely to collapse in the medial and lateral directions, and the load center will be smoothly guided forward by the band-shaped portion.

More preferably, an area that is anterior to the longitudinal arch 1A comprises the forefoot portion F;

an area that is posterior to the longitudinal arch 1A comprises the rear foot portion R;

an area where the longitudinal arch 1A is provided comprises a middle foot portion M between the forefoot portion F and the rear foot portion R; and at least in the middle foot portion M, a ridge 20 is provided extending in the front-rear direction D along the slit S of the lower surface 2*s* of the upper layer 2, and the ridge 20 fits into the slit S of the lower layer 1.

In this case, the ridge 20 of the upper layer 2 is provided in place of the missing portion of the lower layer 1 along the slit S. Therefore, the thickness, i.e., the rigidity, of the midsole 3 along the slit S will not be excessively small.

More preferably, the lower layer 1 protrudes downward of the ridge 20 in each of the medial portion 1M and the lateral portion 1L; and the medial portion 1M of the lower layer 1, the lateral portion 1L of the lower layer 1 and the lower surface 20*s* of the ridge 20 together form a second longitudinal groove G2 extending in the front-rear direction D.

In this case, the second longitudinal groove G2 is likely to exhibit the guidance function described above in the middle foot portion.

More preferably, a depressed portion 10 with a bottom surface extending in the front-rear direction D is formed on the lower layer 1 posterior D2 to the slit S in the lower layer 1, and a posterior end of the second longitudinal groove G2 and an anterior end of the depressed portion 10 are continuous with each other in the front-rear direction D.

In this case, when transitioning from heel contact to foot flat, it will be easy to guide the load center forward over an area extending from the rear foot portion to the middle foot portion, and the center of gravity will likely smoothly move forward.

More preferably, the first longitudinal groove G1 extending in the front-rear direction D is formed on the lower surface 2*s* of the upper layer 2 anterior D1 to the slit S, and a posterior end of the first longitudinal groove G1 and an anterior end of the second longitudinal groove G2 are continuous with each other in the front-rear direction D.

In this case, when transitioning from foot flat to mid stance, it is easy to guide the load center forward smoothly over an area extending from the middle foot portion to the forefoot portion.

More preferably, a plurality of bent grooves G extending in the width direction W are formed on the lower surface 2*s* of the upper layer 2 of the forefoot portion F and anterior D1 to the boundary line L; and one of the plurality of bent grooves G that is closest to the boundary line L and the boundary line L extend parallel to each other in a diagonally posterior direction from the medial side toward the lateral side.

In this case, the boundary line L extends in parallel to the bent groove G that is arranged immediately anterior to the boundary line L, and the rigidity of the midsole at the boundary line L will vary along the bent groove G.

More preferably, a reinforcement device 5 extending in the width direction W so as to bridge over the slit S of the lower layer 1 is provided so as to bridge between the medial portion 1M and the lateral portion 1L without being attached to the lower surface 20*s* of the ridge 20.

The reinforcement device 5 increases the torsional rigidity of the midsole that has been decreased by the slit S. Now, when the reinforcement device 5 is attached to the ridge 20 along the slit S, it detracts from the function of making it easy for the midsole 3 to collapse downward along the slit S.

For this, as the reinforcement device 5 is provided so as to bridge between the medial portion 1M and the lateral portion 1L without being attached to the lower surface 20*s* of the ridge 20, the function of making it easy for the midsole 3 to collapse downward along the slit S to guide the load center forward will be exhibited while increasing the torsional rigidity.

Preferably, the outsole 4 includes a plurality of sole parts 40, and at least one of the plurality of sole parts 40 is arranged extending over the lower layer 1 and the upper layer 2 so as to cover the boundary line L.

In this case, the sole part 40, which is arranged extending extend between the lower layer 1 and the upper layer 2 so as to cover the boundary line L, suppresses a rapid change in the rigidity of the shoe sole at the boundary line L.

Preferably, a first high-hardness portion 17, which is made of a foamed material of a first high hardness, is arranged in a medial edge portion ME of the medial portion 1M of the lower layer 1;

a second high-hardness portion 18, which is made of a foamed material of a second high hardness that is lower than the hardness of the first high-hardness portion 15, is arranged in a central portion 19 of the lower layer 1 between the medial edge portion ME of the medial portion 1M and the first edge E1, which defines the slit S, and in the lateral portion 1L of the lower layer 1; and a hardness of the upper layer 2 is a low hardness that is lower than the hardness of second high-hardness portion 18 in an area that is exposed through the slit S between the medial portion 1M and the lateral portion 1L.

From heel contact to mid stance, pronation is likely to occur, where the foot collapses toward the medial side. For this, the pronation can be suppressed by arranging the first high-hardness portion 17 whose hardness is higher than the lateral portion 1L in the medial edge portion ME.

On the other hand, as the second high-hardness portion 18 whose hardness is higher than the low-hardness foamed material H of the upper layer 2 is arranged in the central portion 19 and the lateral portion 1L, it will be easy for the upper layer 2 to collapse downward along the slit S. As a result, it is possible not only to suppress pronation but also smoothly guide the load center forward.

As the slightly hard second high-hardness portion 18 is arranged between the hard first high-hardness portion 17 and the soft upper layer 2 along the slit S, it will be possible to suppress an excessive change in the hardness of the midsole in the width direction, and suppress an awkward feel on the sole of the foot.

More preferably, the first high-hardness portion 17 extends seamlessly and integrally continuous in the front-rear direction D;

and extends to a position that is anterior to an anterior end of the longitudinal arch 1A and posterior to a posterior end of the longitudinal arch 1A.

Thus, the first high-hardness portion 17, which extends anterior and posterior to the longitudinal arch 1A, has a strong function of suppressing the pronation.

Note that the upper layer made of the low-hardness foamed material H arranged on the lower layer 1 formed of the first high-hardness portion 17 will reduce the upthrust of the first high-hardness portion 17 against the sole of the foot.

Any feature illustrated and/or depicted in conjunction with one of the aforementioned aspects or the following embodiments may be used in the same or similar form in one or more of the other aspects or other embodiments, and/or may be used in combination with, or in place of, any feature of the other aspects or embodiments.

The present invention will be understood more clearly from the following description of preferred embodiments taken in conjunction with the accompanying drawings. Note however that the embodiments and the drawings are merely illustrative and should not be taken to define the scope of the present invention. The scope of the present invention shall be defined only by the appended claims. In the accompanying drawings, like reference numerals denote like components throughout the plurality of figures.

Embodiments

Embodiments of the present invention will now be described with reference to the drawings.

FIG. 1A to FIG. 8C show Embodiment 1.

Figure 8A:
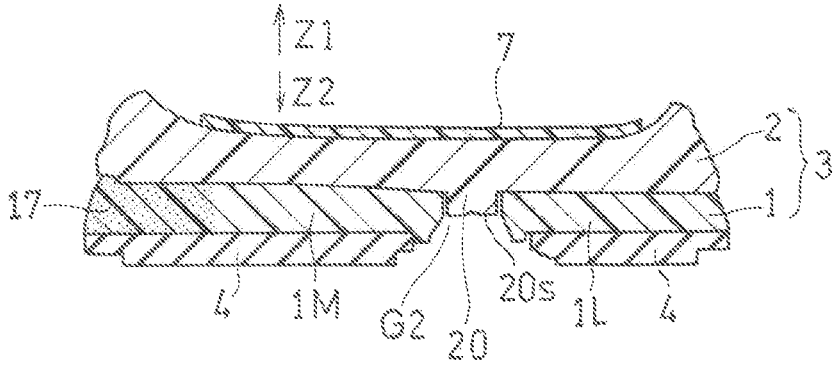
FIG. 8A, FIG. 8B and FIG. 8C are cross-sectional views of the shoe sole taken along line A-A, line B-B and line C-C of FIG. 6, respectively. Note that in these figures, the first high-hardness portion is dotted.
Figure 8B:
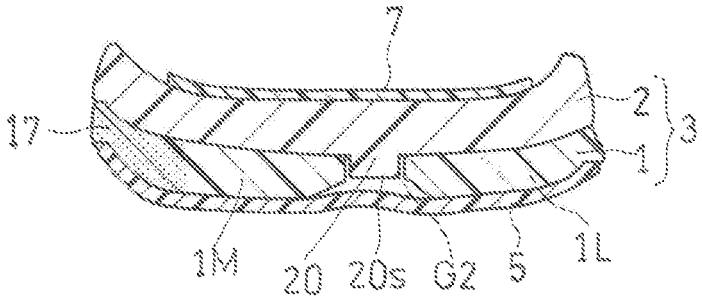
Figure 8C:
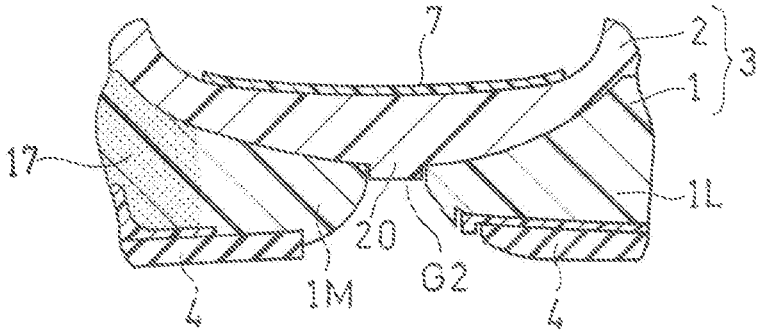

The midsole 3 shown in FIG. 1A is arranged upward Z1 of the outsole 4 as shown in FIG. 8A and FIG. 8C.

Figure 6:
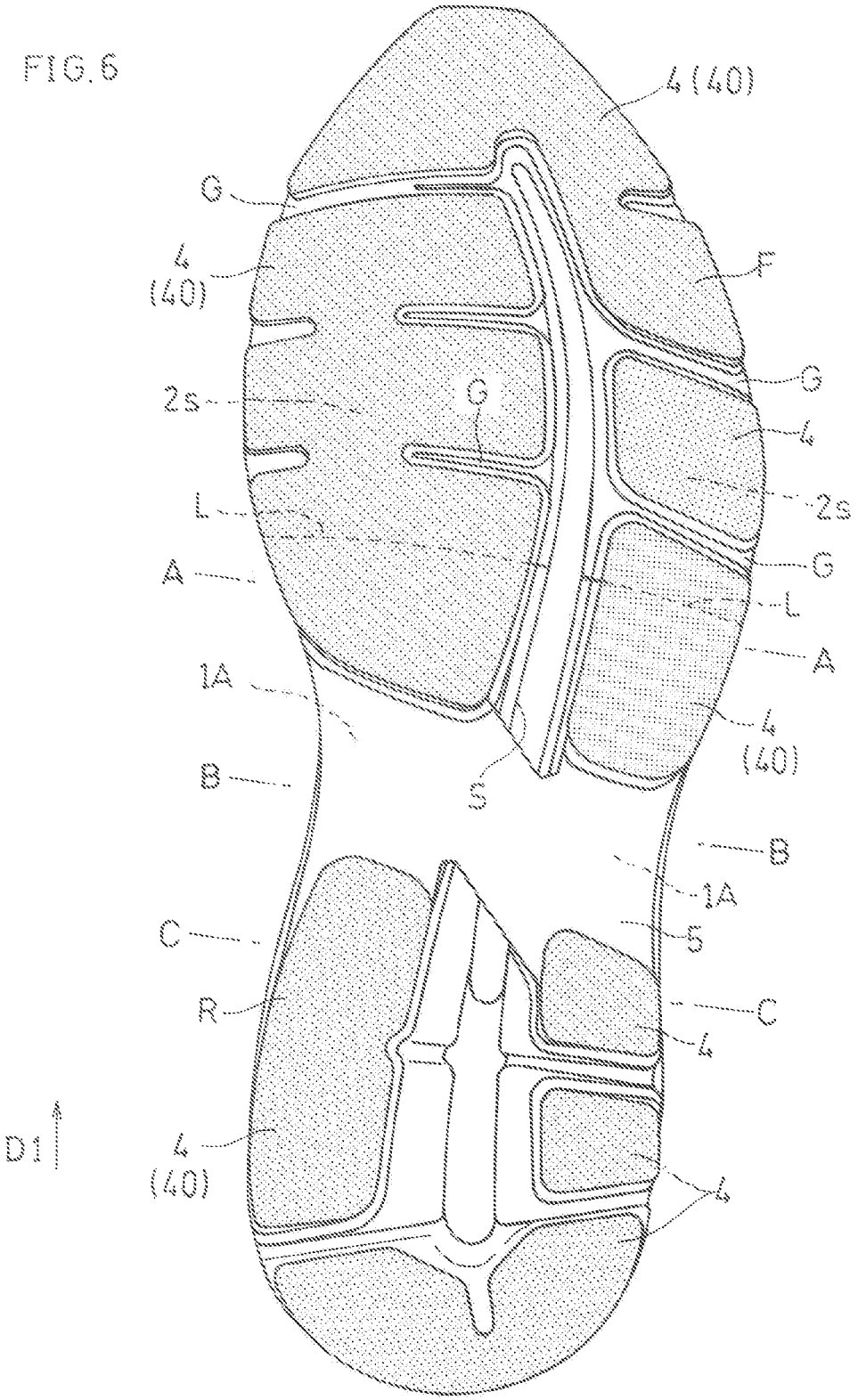
FIG. 6 is a bottom view of the shoe sole. Note that in this figure, the outsole is dotted.
Figure 7A:
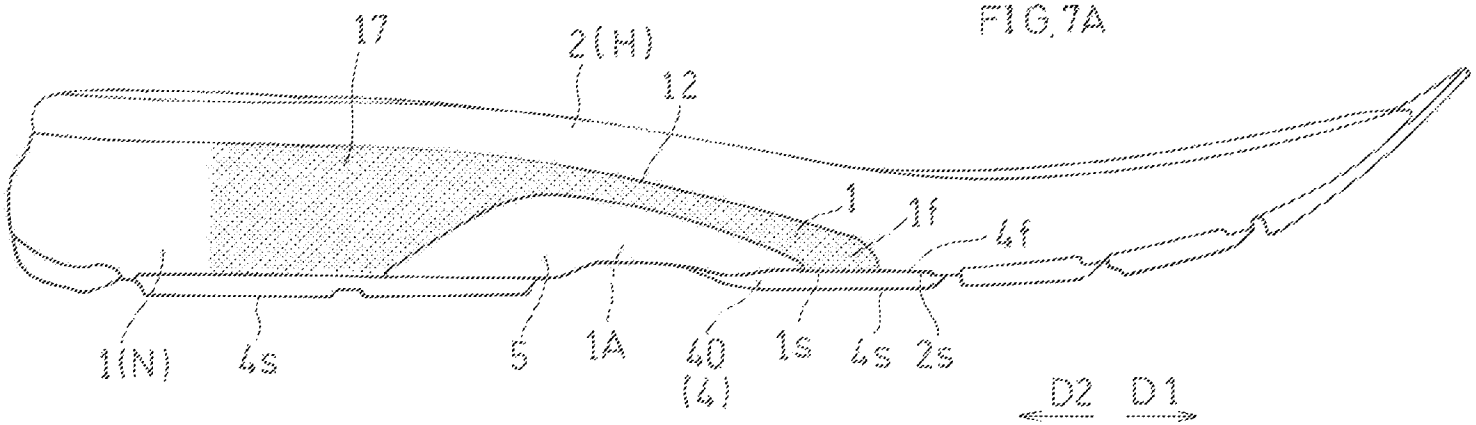
FIG. 7A and FIG. 7B are a medial side view and a lateral side view, respectively, of the shoe sole. Note that in FIG. 7A, the first high-hardness portion is dotted.
Figure 7B:
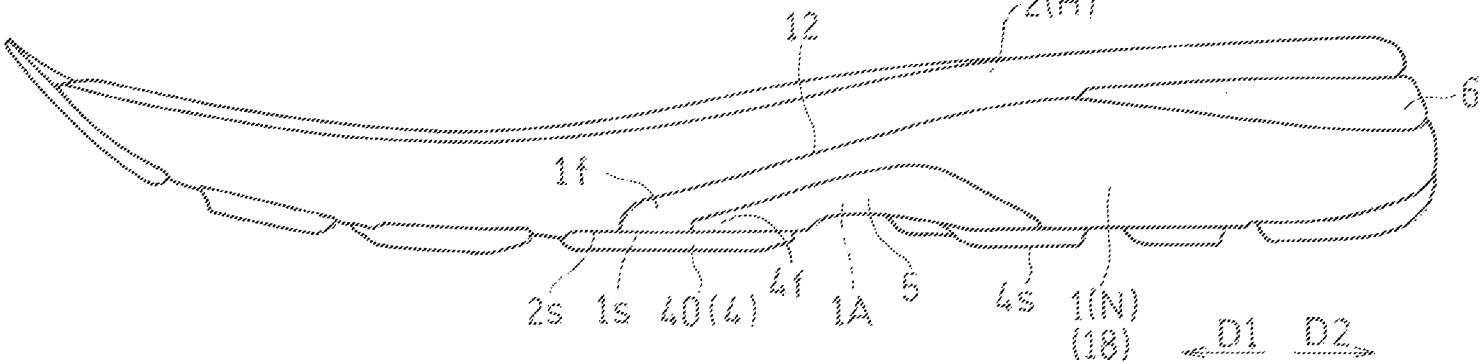

The outsole 4 of FIG. 6 to FIG. 7B has the tread surface 4*s*. Note that the tread surface 4*s* of the outsole 4 has small protrusions/depressions (not shown).

In FIG. 1A, the midsole 3 has the upper layer 2 and the lower layer 1.

The lower layer 1 is made of a layer of the high-hardness foamed material N having a thermoplastic resin component. The upper layer 2 is made of a layer of the low-hardness foamed material H having a thermoplastic resin component.

Figure 2:
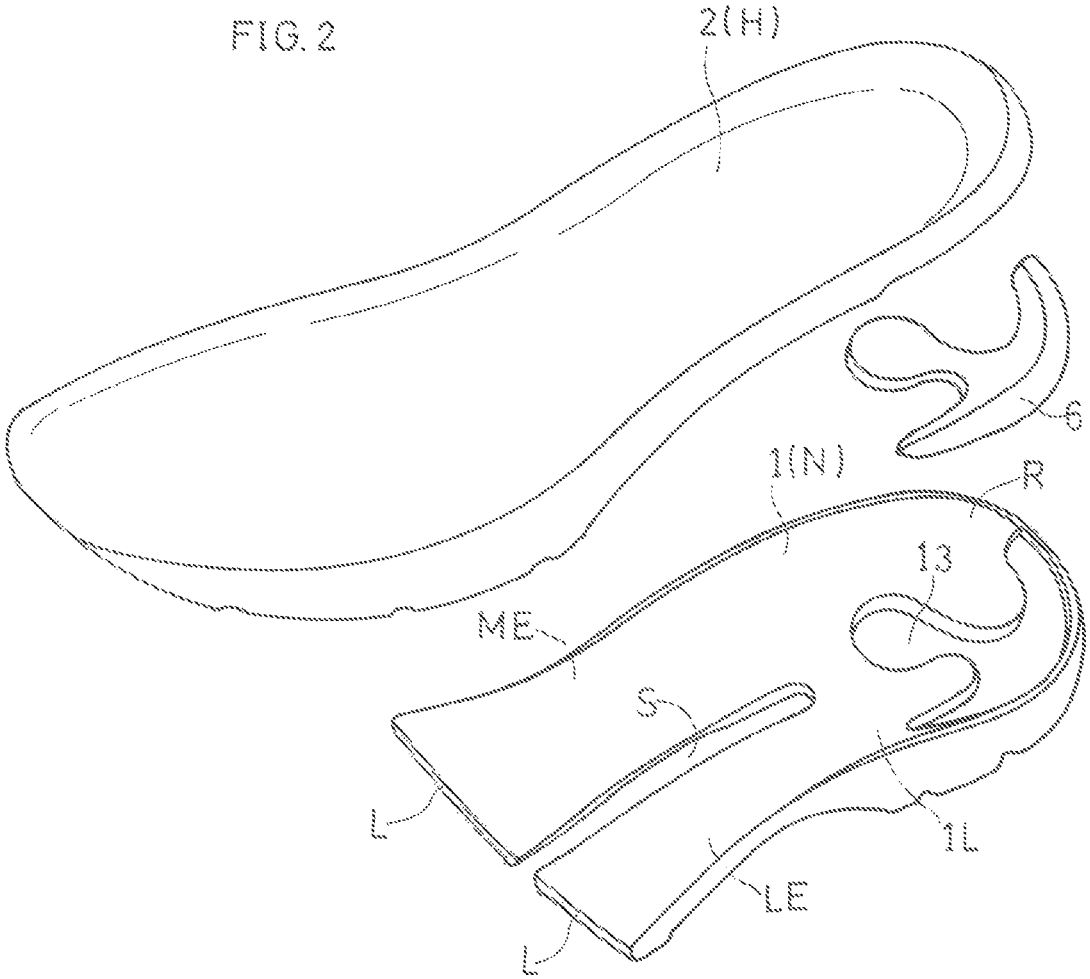
FIG. 2 is a schematic exploded perspective view of the midsole as seen from a diagonally upward direction.

In FIG. 2, the hardness of the high-hardness foamed material N of the lower layer 1 is greater than the hardness of the low-hardness foamed material H of the upper layer 2. For example, the hardness of the lower layer 1 is set to about 53° to 69° in JISK 6301C hardness, and the hardness of the upper layer 2 is set to about 46° to 59° in this C hardness.

Figure 1B:
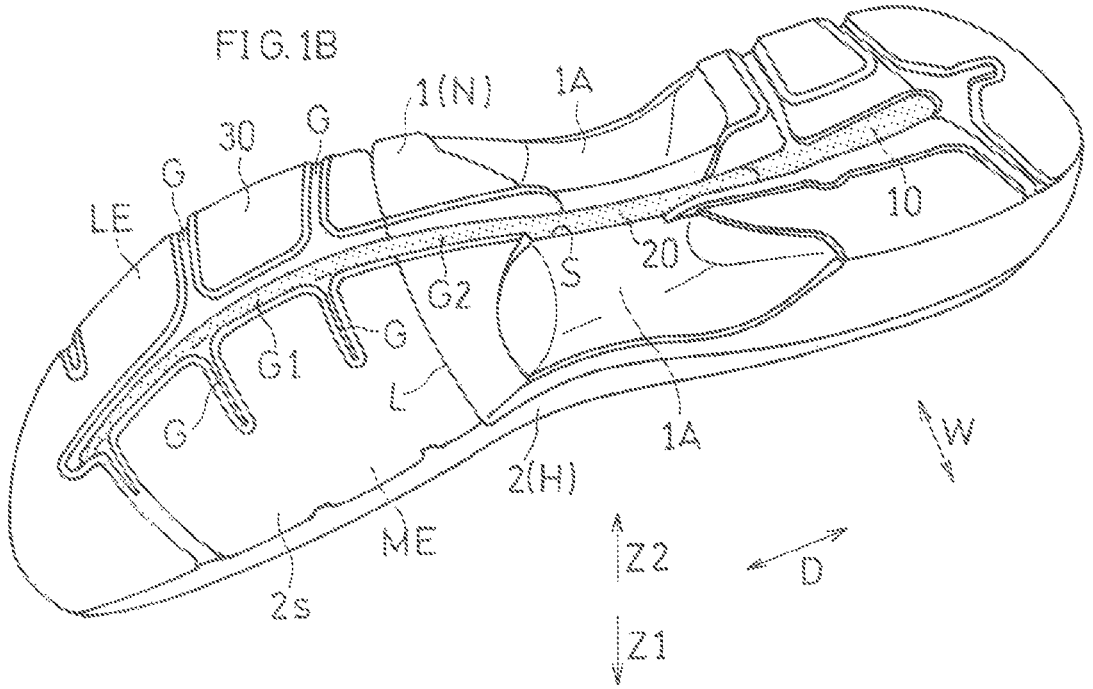

In FIG. 1B, in this embodiment, the lower layer 1 forms the longitudinal arch 1A extending in the front-rear direction D on the medial side and the lateral side, and the longitudinal arch 1A has a lower surface that is depressed facing downward Z2.

Figure 4:
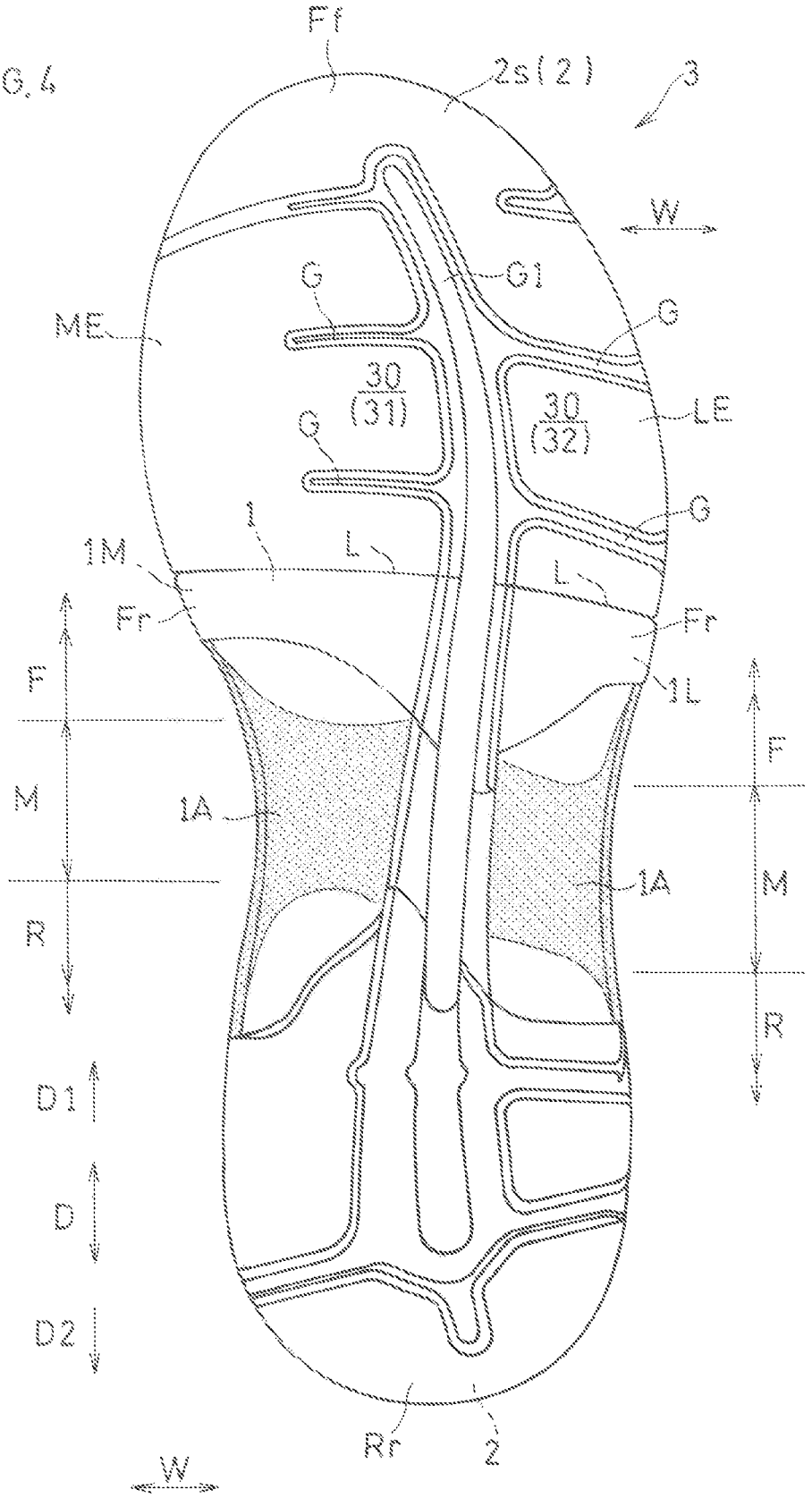
FIG. 4 is a bottom view of the midsole. Note that in this figure, the medial and lateral longitudinal arches are dotted.

As shown in FIG. 4, an area that is anterior to the longitudinal arch 1A, which is dotted, comprises the forefoot portion F. An area that is posterior to the longitudinal arch 1A comprises the rear foot portion R. The area where the longitudinal arch 1A is provided comprises the middle foot portion M between the forefoot portion F and the rear foot portion R.

In this embodiment, as shown in FIG. 6, a dotted area where the outsole 4 is arranged that is anterior to the longitudinal arch 1A is the forefoot portion F, and a dotted area where the outsole 4 is arranged that is posterior to the longitudinal arch 1A is the rear foot portion R.

The longitudinal arch 1A of FIG. 4 is provided in an area that corresponds to the arch portion of the foot, and has a lower surface that protrudes upward as shown in FIG. 7A and FIG. 7B, thereby creating a gap between the lower surface and the flat road surface. Typically, it is often covered by the reinforcement device 5 as shown in FIG. 6.

Directly above the longitudinal arch 1A of FIG. 7A and FIG. 7B, a joint surface 12 between the upper layer 2 and the lower layer 1 forms a downward slope that slopes down in the anterior D1 direction. The upper layer 2 and the lower layer 1 are bonded together at the joint surface 12.

The low-hardness foamed material H of the upper layer 2 is (made from) a low-hardness and high-resilience material that has a higher specific gravity than the high-hardness foamed material N, that has a low hardness that is lower than the hardness of the high-hardness foamed material N, and that has a higher speed at which to recover to the original shape after being deformed than that of the high-hardness foamed material N. The upper layer 2 made of the low-hardness and high-resilience material has a higher speed of deformation than the lower layer 1 made of the high-hardness foamed material N.

Note that the high-hardness foamed material N of the lower layer 1 is a foamed material that is employed as an ordinary midsole material.

In FIG. 4, the upper layer 2 is seamlessly and integrally continuous over the entire length of the midsole from the posterior end portion Rr of the rear foot portion R to the anterior end portion Ff of the forefoot portion F. The lower layer 1 is seamlessly and integrally continuous from the posterior end portion Rr of the rear foot portion R to the posterior end portion Fr of the forefoot portion F.

As shown in FIG. 2, a depression 13 to be loaded with a shock-absorbing part 6 is provided in the lateral portion 1L of the rear foot portion R of the lower layer 1. The shock-absorbing part 6 is a jelly-like elastomer, for example, and is sandwiched between the lower layer 1 and the upper layer 2 as shown in FIG. 1A.

At the boundary line L on the side of the lower surface of the midsole 3 of FIG. 4, the anterior end of the lower layer 1 is in contact with the upper layer 2. The boundary line L is the line of the anterior end of the lower layer 1, serves as the front-rear boundary between the upper layer 2 and the lower layer 1, and is arranged at the posterior end portion Fr of the forefoot portion F.

In the forefoot portion F, the lower surface 2*s* of the upper layer 2 has the primary tread portion 30 between the medial edge portion ME and the lateral edge portion LE of the midsole 3, and the line of the posterior end of the primary tread portion 30 is defined by the boundary line L.

In this embodiment, the boundary line L extends to the medial-side edge of the midsole 3 in the posterior end portion Fr of the forefoot portion F, and extends to the lateral-side edge of the midsole 3 in the posterior end portion Fr of the forefoot portion F.

Figure 5:
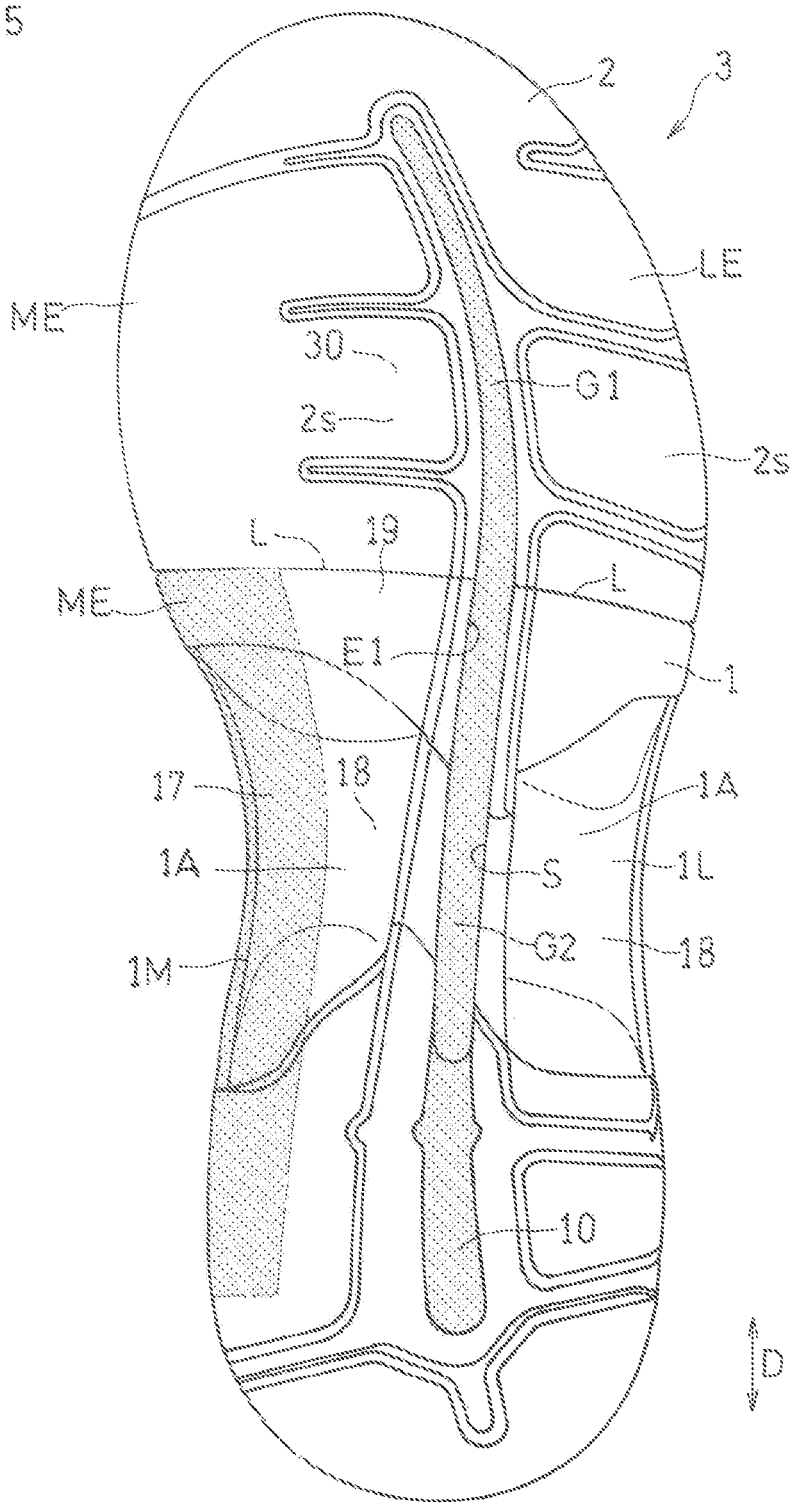
FIG. 5 is a bottom view of the midsole. Note that in this figure, the first high-hardness portion, the longitudinal groove and the depressed portion are dotted.

As shown in FIG. 1B and FIG. 5, the first longitudinal groove G1 extending in the front-rear direction D is formed on the primary tread portion 30 of the lower surface 2*s* of the upper layer 2.

In FIG. 4, the primary tread portion 30 includes the first primary portion 31 between the first longitudinal groove G1 and the medial edge portion ME, and includes the second primary portion 32 between the first longitudinal groove G1 and the lateral edge portion LE.

The size of the first primary portion 31 in the width direction W is larger than that of the second primary portion 32. That is, on a cross section of the primary tread portion 30 along one of a plurality of bent grooves G provided on the upper layer 2 of the forefoot portion F and extending in the width direction W that is immediately anterior to the boundary line L, the size of the first primary portion 31 in the width direction W is larger than that of the second primary portion 32.

In FIG. 5, of the lower surface 2*s* of the primary tread portion 30 of the upper layer 2, the first lower surface 2*s* that is on the medial side relative to the first longitudinal groove G1 and the second lower surface 2*s* that is on the lateral side relative to the first longitudinal groove G1 are not covered by the lower layer 1 and each form the lower surface of the midsole 3. As shown in FIG. 6, the upper surface 4*f* (FIG. 7A) of the outsole 4 is attached to the first and second lower surfaces 2*s*, As shown in FIG. 4 and FIG. 6, the upper surface 4*f* (FIG. 7A, FIG. 7B) of the outsole 4 is attached to the lower surface 2*s* of the upper layer 2 in the primary tread portion 30 (FIG. 4) of the forefoot portion F that is anterior D1 to the boundary line L. In FIG. 6, the outsole 4 is composed of sole parts 40 separated from one another.

As shown in FIG. 7A and FIG. 7B, in the forefoot portion F (FIG. 4), the upper surface 4*f* of one part 40 of the outsole 4 is attached to the lower surfaces 1*s* and 2*s* so as to bridge between the lower surface 1*s* of the anterior edge region 1*f* of the lower layer 1 and the lower surface 2*s* of an area of the upper layer 2 that is adjacent to the anterior edge region 1*f* of the lower layer 1.

That is, as shown in FIG. 6, the outsole 4 includes a plurality of sole parts 40, and on the medial side and the lateral side, these two of the sole parts 40 are attached to the lower layer 1 and the upper layer 2 while being arranged extending over the lower layer 1 and the upper layer 2 so as to cover the boundary line L.

In FIG. 7A and FIG. 7B, the upper layer 2 is formed to be thickest in an area that is anterior D1 to the boundary line L (FIG. 4). On the other hand, the lower layer 1 is formed to be thickest in an area that is posterior D2 to the longitudinal arch 1A.

In FIG. 4, the lower layer 1 extends to a position posterior D2 to the longitudinal arch 1A. The boundary line L of the lower layer 1 is arranged anterior D1 to the longitudinal arch 1A. The boundary line L is arranged posterior D2 to the bent grooves G extending in the width direction W that are provided on the upper layer 2 of the forefoot portion F.

The boundary line L of FIG. 4 extends in a diagonal posterior D2 direction from the medial portion 1M toward the lateral portion 1L.

Figure 11:
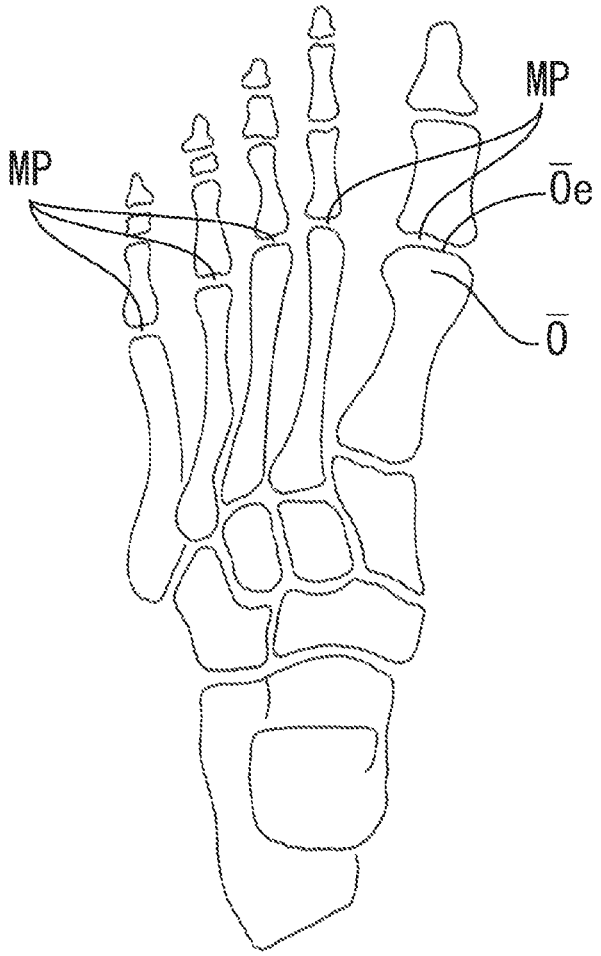
FIG. 11 is a schematic plan view showing the foot bone structure.

On the medial side, the boundary line L is configured so as to be arranged posterior D2 to the anterior end of the ball O of the big toe of the wearer of FIG. 11. That is, this embodiment is configured so that the lower layer 1 is not arranged while the upper layer 2 and the outsole 4 (FIG. 6) are arranged directly under the metatarsal phalangeal joint MP of the foot of the wearer of FIG. 11.

Figure 3:
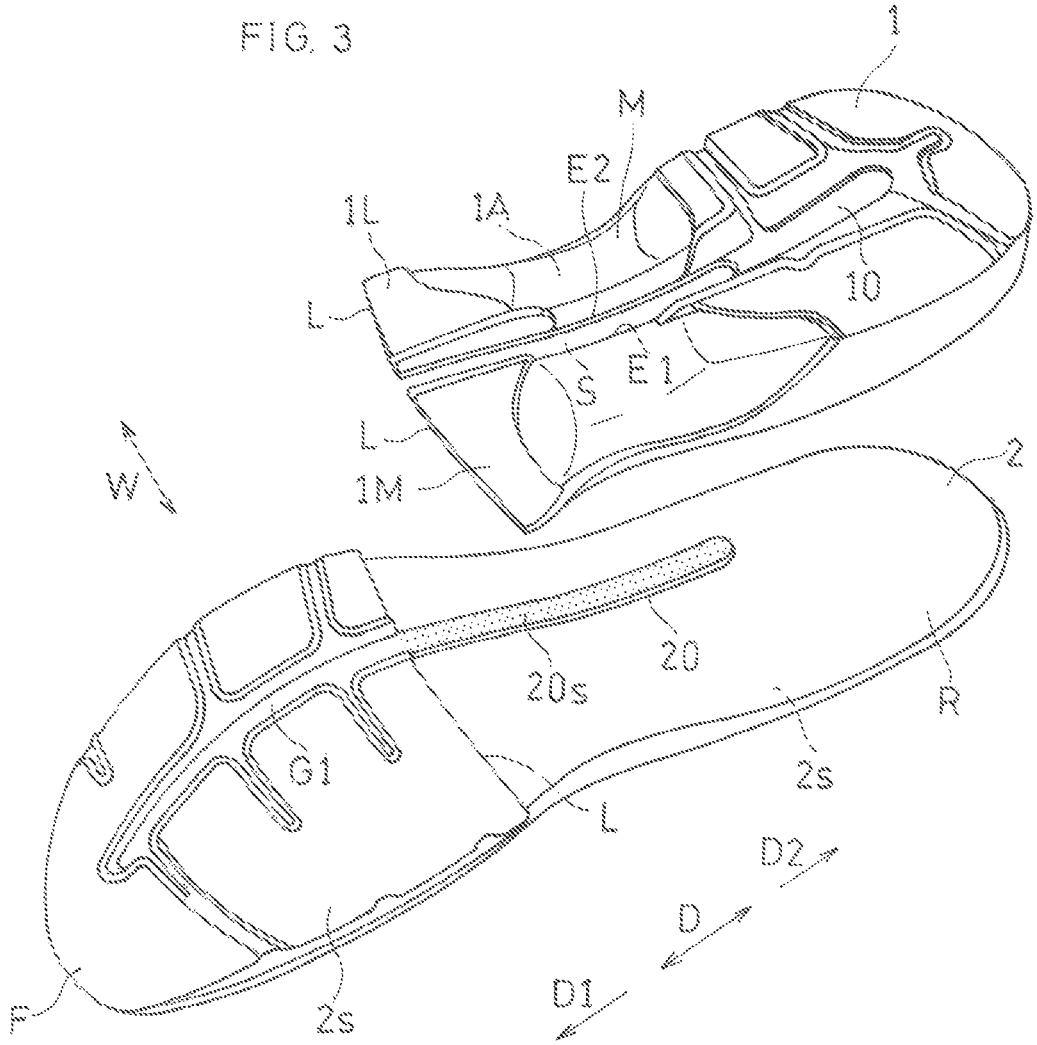
FIG. 3 is a schematic exploded perspective view of the midsole as seen from a diagonally lower direction. Note that in FIG. 3, the ridge is dotted.

In the forefoot portion F and the middle foot portion M (FIG. 4), the lower layer 1 of FIG. 3 is divided into the medial portion 1M and the lateral portion 1L. The first edge E1 on the central side of the lower layer 1 of the medial portion 1M and the second edge E2 on the central side of the lower layer 1 of the lateral portion 1L are spaced apart from each other in the width direction W.

In FIG. 1B and FIG. 4, the lower layer 1 forms the longitudinal arch 1A extending in the front-rear direction D in the medial portion 1M and in the lateral portion 1L. As shown in FIG. 1A, the longitudinal arch 1A has a lower surface that is depressed facing downward.

The first edge E1 on the central side of the lower layer 1 of the medial portion 1M and the second edge E2 on the central side of the lower layer 1 of the lateral portion 1L of FIG. 3 define the narrow slit S extending in the front-rear direction D from the posterior end portion Fr of the forefoot portion F that is anterior D1 to the longitudinal arch 1A to a position posterior D2 to the longitudinal arch 1A. When the lower layer 1 and the upper layer 2 are layered together, the upper layer 2 is exposed uncovered by the lower layer 1 through the slit S. Note that the medial portion 1M and the lateral portion 1L may be seamlessly continuous with each other in the width direction at the anterior edge of the lower layer 1, and the slit S may be absent (i.e., not provided) at the anterior edge of the lower layer 1.

In the forefoot portion F and the middle foot portion M of FIG. 3, the ridge 20 extending in the front-rear direction D along the slit S is provided on the lower surface 2*s* of the upper layer 2. In FIG. 1B, the ridge 20 fits into the slit S of the lower layer 1.

In this embodiment, the lower layer 1 of FIG. 5 includes the first high-hardness portion 17 in the medial portion 1M, and the second high-hardness portion 18 whose hardness is lower than that of the first high-hardness portion 17 in the lateral portion 1L. The hardness of the upper layer 2 is the low hardness that is lower than the second high hardness in an area that is exposed through the slit S between the medial portion 1M and the lateral portion 1L.

More specifically, in FIG. 5, the dotted first high-hardness portion 17, which is made of a foamed material of the first high hardness, is arranged in the medial edge portion ME of the medial portion 1M of the lower layer 1.

On the other hand, the second high-hardness portion 18, which is made of a foamed material of a second high hardness that is lower than that of the first high-hardness portion 17, is arranged in the central portion 19 (between the first edge E1 on the central side of the lower layer 1 of the medial portion 1M, which defines the slit S, and the first high-hardness portion 17) and in the lateral portion 1L of the lower layer 1.

The hardness of the upper layer 2 is the low hardness that is lower than the hardness of the second high-hardness portion 18 over the entire area including the area between the medial portion 1M and the lateral portion 1L that is exposed through the slit S.

The boundary between the first high-hardness portion 17 and the second high-hardness portion 18 of the central portion 19 is arranged along the medial edge portion ME as indicated by a two-dot-chain line. The first high-hardness portion 17 extends seamlessly and integrally continuous in the front-rear direction D to a position that is anterior to the anterior end of the longitudinal arch 1A and posterior to the posterior end of the longitudinal arch 1A.

In this embodiment, the high hardness of the first high-hardness portion 17 of the medial portion 1M is set to 61° to 69°, and more preferably 63° to 67°, in the C hardness described above. The high hardness of the second high-hardness portion 18 of the central portion 19 and the second high-hardness portion 18 of the lateral portion 1L is set to 53° to 61°, and more preferably 55° to 59°, in the C hardness described above. The low hardness of the upper layer 2 is set to 51° to 59°, and more preferably 53° to 57° in the C hardness.

The hardness difference between the first high hardness and the second high hardness is preferably about 5° to 10° in the C hardness described above, and the hardness difference between the second high hardness and the low hardness is preferably about 1° to 8° in the C hardness described above. Note that the second high hardness of the central portion 19 and the second high hardness of the lateral portion 1L may be different from each other. That is, the second high hardness means that it is lower than the first high hardness and higher than the low hardness.

These appropriate hardness differences serve to suppress pronation and to provide guidance.

As shown in FIG. 8A to FIG. 8C, the lower layer 1 protrudes downward Z2 of the ridge 20 in each of the medial portion 1M and the lateral portion 1L. The medial portion 1M of the lower layer 1, the lateral portion 1L of the lower layer 1 and the lower surface 20*s* of the ridge 20 together form the second longitudinal groove G2 (FIG. 5) extending in the front-rear direction D.

In FIG. 3, the depressed portion 10 with a bottom surface extending in the front-rear direction D is formed on the lower layer 1 posterior D2 to the slit S in the lower layer 1. The posterior end of the second longitudinal groove G2 and the anterior end of the depressed portion 10 (the anterior end of the lower surface 20*s* of the ridge 20 forming the second longitudinal groove G2) of FIG. 1B are continuous with each other in the front-rear direction D.

The first longitudinal groove G1 extending in the front-rear direction D is formed on the lower surface 2*s* of the upper layer 2 anterior D1 to the slit S of FIG. 3. The posterior end of the first longitudinal groove G1 and the anterior end of the second longitudinal groove G2 are continuous with each other in the front-rear direction D.

A plurality of bent grooves G extending in the width direction W are formed on the lower surface 2*s* of the upper layer 2 of the forefoot portion F of FIG. 1B. One of the plurality of bent grooves G of FIG. 4 that is closest to the boundary line L and the boundary line L extend parallel to each other in a diagonally posterior direction from the medial side toward the lateral side.

These bent grooves G make it easier for the midsole to bend following plantar/dorsiflexion of the foot. Note that other bent grooves may be provided on the upper surface of the upper layer 2.

As shown in FIG. 6, the sole parts 40 of the outsole 4 are separated from each other in accordance with the bent grooves G. Notches are formed in the sole parts 40 in accordance with the bent grooves G.

As shown in FIG. 6, FIG. 7 and FIG. 8B, the reinforcement device 5 is provided in the longitudinal arch 1A, extending in the width direction W so as to bridge over the slit S of the lower layer 1.

In FIG. 8B, the reinforcement device 5 is provided so as to bridge between the medial portion 1M and the lateral portion 1L without being attached to the lower surface 20*s* of the ridge 20. The reinforcement device 5 is formed by a non-foamed resin such as a thermoplastic resin, for example.

Note that the reinforcement device 5 suppresses bending and twisting of the midsole 3.

As shown in FIG. 8A to FIG. 8C, an insole 7 is arranged and attached on the midsole 3. The insole 7 may be integral with the upper (not shown), and may be made of a flat plate-shaped foamed material, for example, and softer than the midsole 3.

Note that a sock liner made of a molded foamed material is arranged on the insole 7.

In the following examples, like elements to those of Embodiment 1 will be denoted by like reference numerals and will not be further described below, and the following description will mainly focus on what is different from Embodiment 1.

Figure 9:
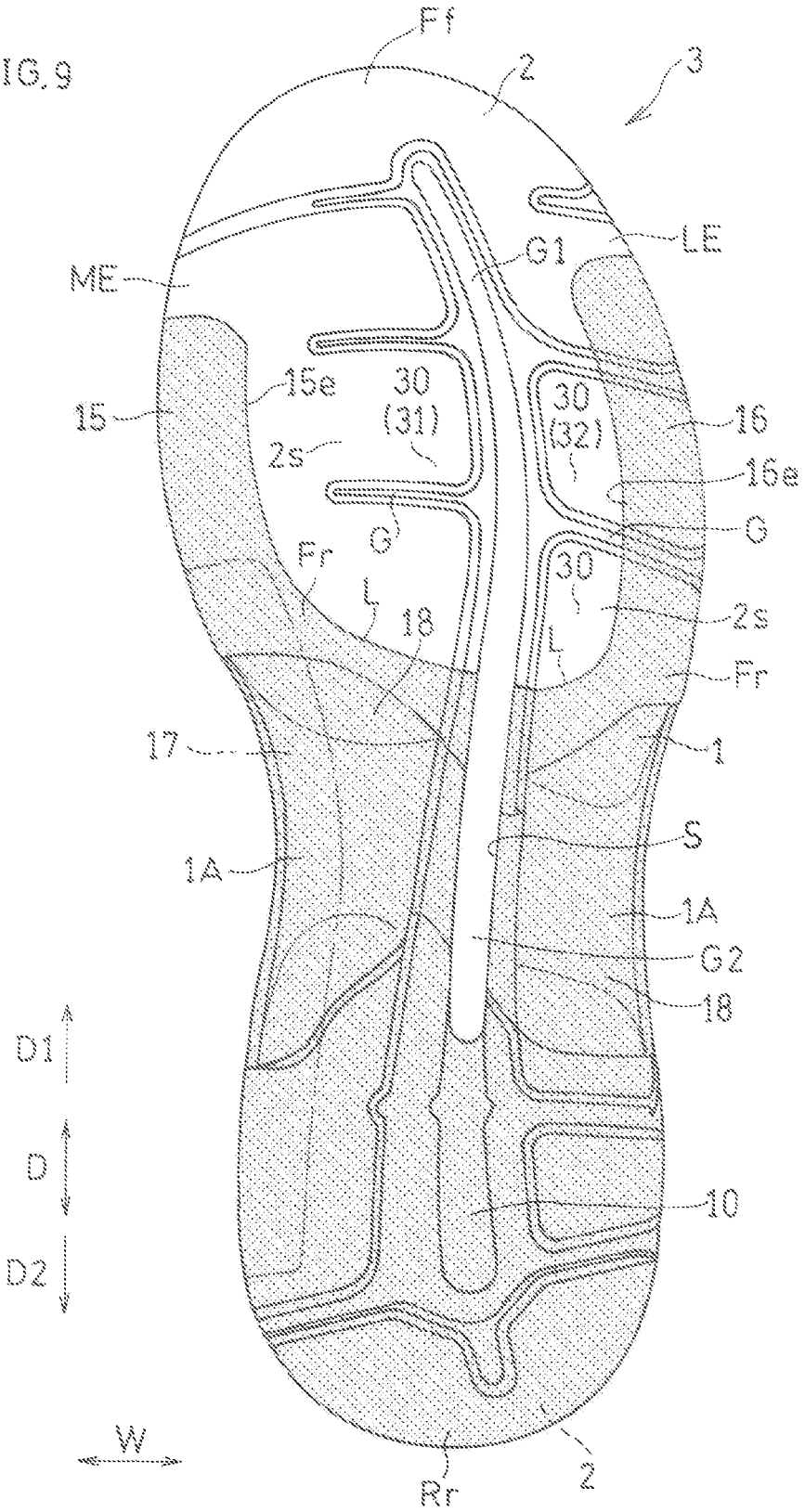
FIG. 9 is a bottom view of a midsole according to Embodiment 2. In this figure, the lower surface of the midsole of the lower layer is dotted.
Figure 10:
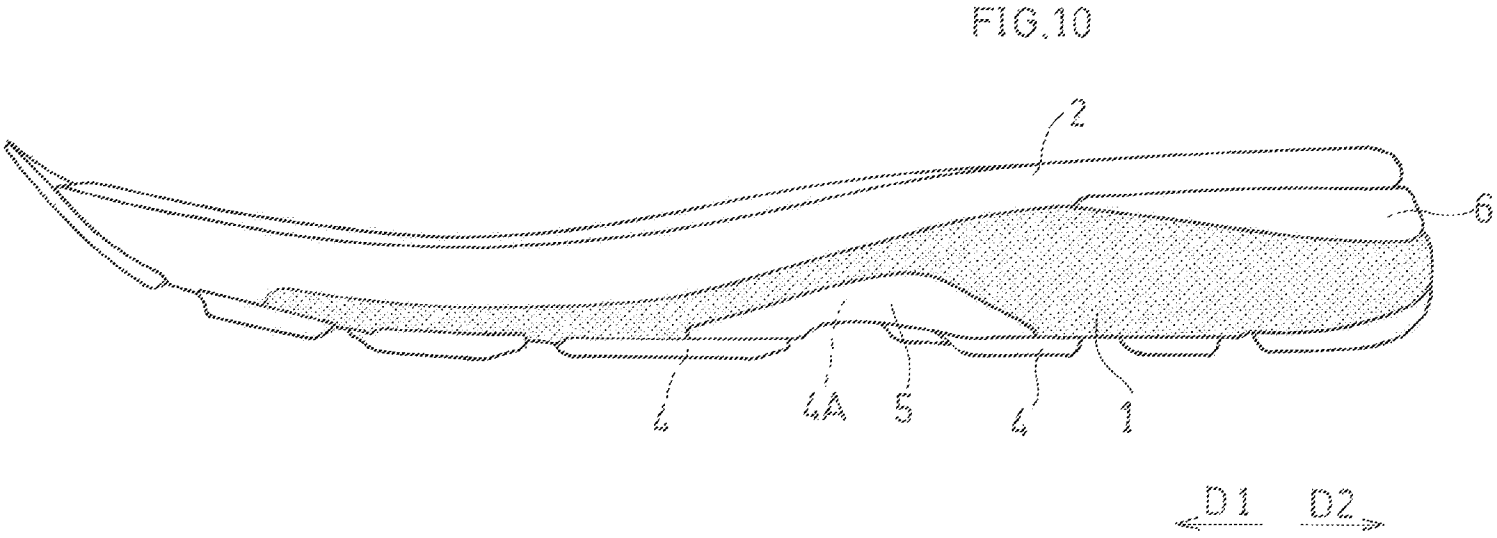
FIG. 10 is a lateral side view of a shoe sole including the midsole. In this figure, the side surface of the midsole of the lower layer is dotted.

FIG. 9 and FIG. 10 show Embodiment 2. FIG. 9 only shows the midsole 3.

As shown in FIG. 9, the lower layer 1 includes the first protruding portion 15 that extends along the medial edge portion ME of the midsole 3 to a position anterior D1 to the posterior end portion Fr of the forefoot portion F (FIG. 4), and the second protruding portion 16 that extends along the lateral edge portion LE of the midsole 3 to a position anterior D1 to the posterior end portion Fr of the forefoot portion F.

The inner edge 15*e* of the first protruding portion 15 on the central side and the inner edge 16*e* of the second protruding portion 16 on the central side oppose each other in the width direction W and are spaced apart from each other.

The primary tread portion 30 is formed between the first protruding portion 15 and the second protruding portion 16, and the boundary line L, which defines the line of the posterior end of the primary tread portion 30, is arranged at the posterior end portion Fr of the forefoot portion F.

The boundary line L is arranged posterior to the bent groove G that extends over more than a half of the primary tread portion 30 in the width direction W.

The first longitudinal groove G1 extending in the front-rear direction D is formed on the primary tread portion 30.

Of the lower surface 2*s* of the primary tread portion 30 of the upper layer 2, the first lower surface 2*s* that is on the medial side relative to the first longitudinal groove G1 and the second lower surface 2*s* that is on the lateral side relative to the first longitudinal groove G1 are not covered by the lower layer 1; each form the lower surface of the midsole 3; and are attached to the upper surface of the outsole 4.

The primary tread portion 30 includes the first primary portion 31 that is between the inner edge 15*e* of the first protruding portion 15 on the central side and the first longitudinal groove G1, and the second primary portion 32 that is between the inner edge 16*e* of the second protruding portion 16 on the central side and the first longitudinal groove G1.

The size of the first primary portion 31 in the width direction W is larger than that of the second primary portion 32. That is, on a cross section of the primary tread portion 30 along the bent groove G that is immediately anterior to the boundary line L, the size of the first primary portion 31 in the width direction W is larger than that of the second primary portion 32. The size of the primary tread portion 30 in the width direction W on the cross section is larger than the total size of the first and second protruding portions 15 and 16 in the width direction W on the cross section.

Figure 13A:
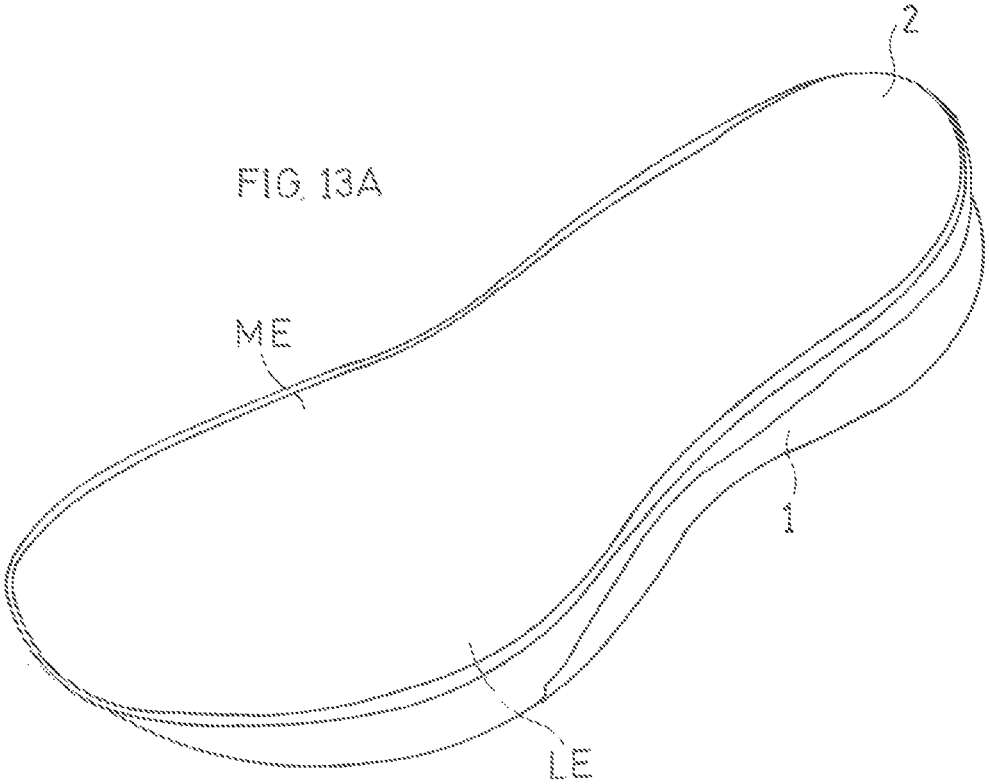
FIG. 13A and FIG. 13B are schematic perspective views of a midsole according to Embodiment 3 of the present invention as seen from a diagonally upper direction and a diagonally lower direction, respectively.

Next, Embodiment 3 of FIG. 13A to FIG. 14 will be described.

These figures only show the midsole.

Figure 13B:
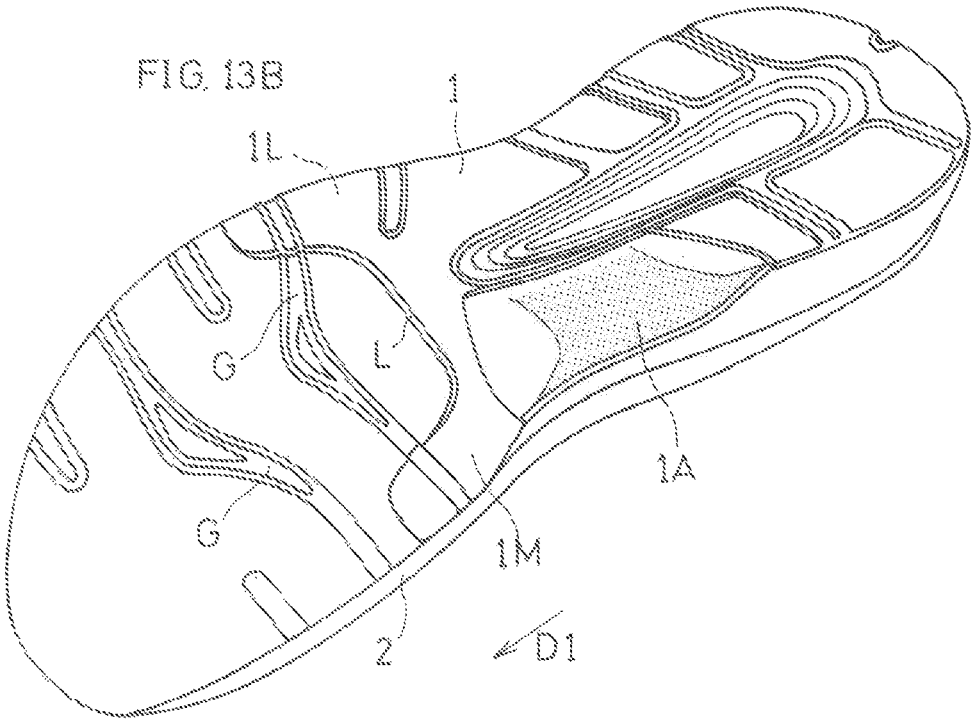
Figure 14:
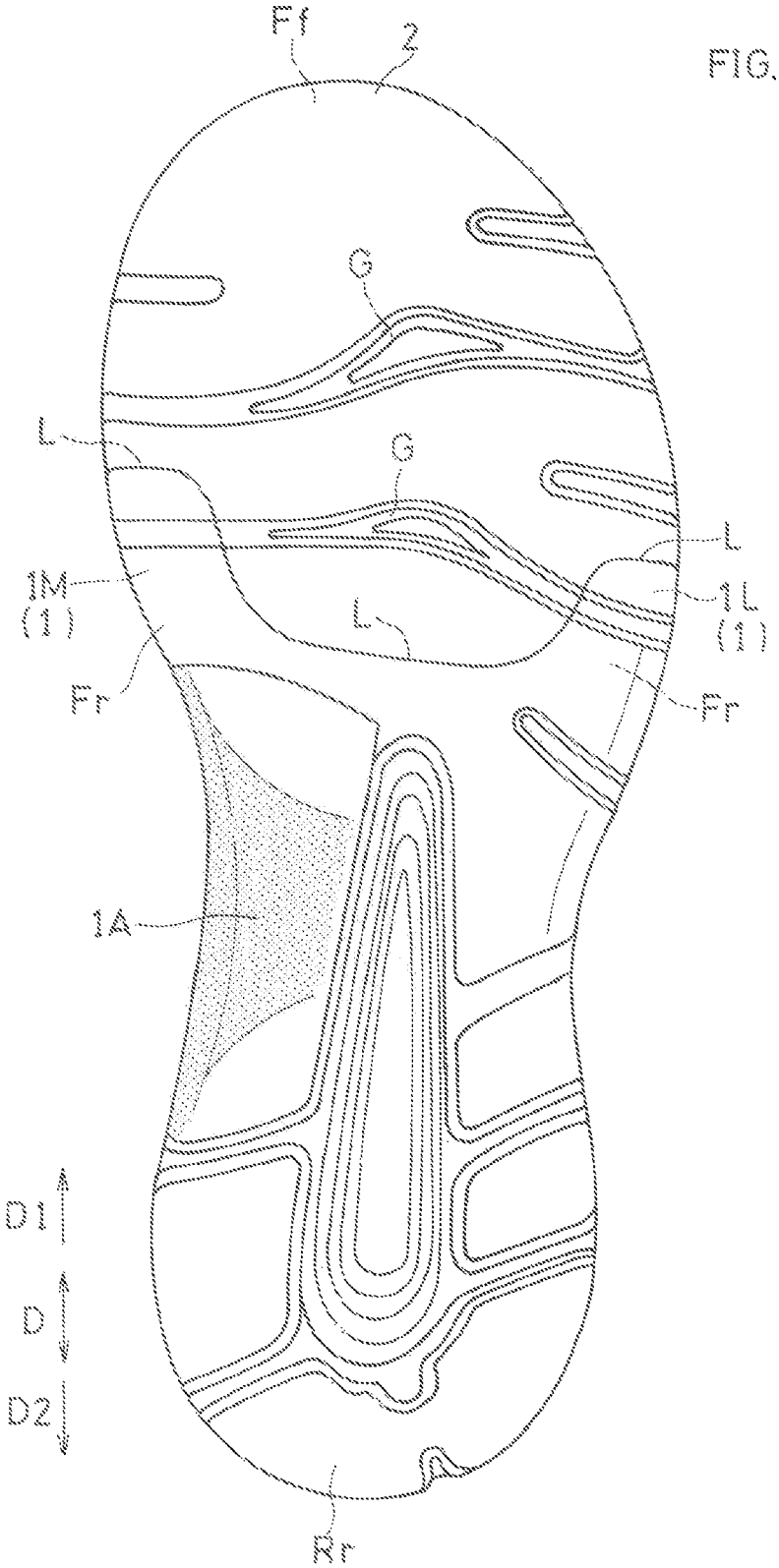
FIG. 14 is a bottom view of the midsole. In this figure, the longitudinal arch is dotted.

In the middle between the medial portion 1M and the lateral portion 1L of the lower layer 1 of FIG. 13B and FIG. 14, the boundary line L is arranged posterior D2 to the most posterior one of a plurality of bent grooves G in the forefoot portion F.

On the other hand, in the medial portion 1M and in the lateral portion 1L, the boundary line L is arranged anterior D1 to the most posterior bent groove G. That is, the lower layer 1 extends so as to protrude in the anterior D1 direction in the medial portion 1M and in the lateral portion 1L.

As shown in FIG. 13B, in this embodiment, the dotted longitudinal arch 1A is provided only in the medial portion 1M. Note that a reinforcement device (not shown) is attached to the longitudinal arch 1A.

In this embodiment, the first longitudinal groove G1 is not provided.

While preferred embodiments have been described above with reference to the drawings, various obvious changes and modifications will readily occur to those skilled in the art upon reading the present specification.

For example, the hardness of the foamed material of the lower layer may be equal on the medial side and on the lateral side.

Shock-absorbing elements other than the foamed material, e.g., pods of a non-foamed material filled with a gel or the air, may be included in the upper layer and/or the lower layer.

Grooves extending in the up-down direction may be formed on the side surface or the back surface of the midsole.

Thus, such changes and modifications are deemed to fall within the scope of the present invention.

INDUSTRIAL APPLICABILITY

The present invention is applicable to shoe soles having a midsole.

REFERENCE SIGNS LIST

1: Lower layer, 1*f*: Anterior edge region, 1*s*: Lower surface, 10: Depressed portion, 11: boundary, 12: Joint surface, 13: Depression, 15: First protruding portion, 15*e*: Inner edge, 16: Second protruding portion, 16*e*: Inner edge, 17: First high-hardness portion, 18: Second high-hardness portion, 1A: Longitudinal arch, 1M: Medial portion, 1L: Lateral portion

2: Upper layer, 2*s*: Lower surface, 20: Ridge

3: Midsole, 30: Primary tread portion, 31: First primary portion, 32: Second primary portion

4: Outsole, 4*f* Upper surface, 40: Sole part

5: Reinforcement device, 6: Shock-absorbing part, 7: Insole

D: Front-rear direction, D1: Anterior, D2: Posterior

E1: First edge, E2: Second edge

F: Forefoot portion, Ff: Anterior end portion, Fr: Posterior end portion

R: Rear foot portion, Rr: Posterior end portion, M: Middle foot portion

G: Bent groove, G1: First longitudinal groove, G2: Second longitudinal groove L: Boundary line, H: Low-hardness foamed material, N: High-hardness foamed material ME: Medial edge portion, LE: Lateral edge portion W: Width direction, Z1: Upward, Z2: Downward

The invention claimed is:

1. A shoe sole comprising: an outsole having a tread surface; and a midsole arranged on the outsole, wherein:

the midsole includes an upper layer and a lower layer each of a foamed material;

the upper layer is a low-hardness foamed material having a thermoplastic resin component;

the lower layer is a high-hardness foamed material that has a thermoplastic resin component and has a high hardness that is higher than a hardness of the low-hardness foamed material;

the upper layer is seamlessly and integrally continuous from a posterior end portion of a rear foot portion to an anterior end portion of a forefoot portion;

the lower layer is seamlessly and integrally continuous from the posterior end portion of the rear foot portion to a posterior end portion of the forefoot portion;

a boundary line, which is a line of an anterior end of the lower layer and is an anterior-posterior boundary between the upper layer and the lower layer, is arranged at the posterior end portion of the forefoot portion;

in the forefoot portion, a lower surface of the upper layer includes a primary tread portion between a medial edge portion and a lateral edge portion of the midsole, and a line of a posterior end of the primary tread portion is defined by the boundary line;

in the primary tread portion of the forefoot portion anterior to the boundary line, an upper surface of the outsole is attached to the lower surface of the upper layer;

the low-hardness foamed material of the upper layer is made from a low-hardness, high-resilience material having a higher specific gravity than the high-hardness foamed material, the low-hardness, high-resilience material having a low hardness that is lower than the hardness of the high-hardness foamed material, and the low-hardness, high-resilience material having a higher speed at which to recover to an original shape after being deformed than that of the high-hardness foamed material, at least in the forefoot portion, the lower layer is divided into a medial portion and a lateral portion;

a first edge on a central side of the lower layer of the medial portion and a second edge on the central side of the lower layer of the lateral portion are spaced apart from each other in a width direction;

at least in the medial portion, the lower layer forms a longitudinal arch extending in a front-rear direction, and the longitudinal arch has a lower surface that is depressed facing downward;

the first edge on the central side of the lower layer of the medial portion and the second edge on the central side of the lower layer of the lateral portion define a narrow slit extending in the front-rear direction from the forefoot portion to a position posterior to the longitudinal arch;

the upper layer is exposed uncovered by the lower layer through the slit;

at least in the middle foot portion, a ridge is provided on the lower surface of the upper layer, the ridge extending in the front-rear direction along the slit, the ridge fitting into the slit of the lower layer;

a first longitudinal groove extending in the front-rear direction is formed on the primary tread portion; and the first longitudinal groove is formed anterior to the slit, and a posterior end of the first longitudinal groove and an anterior end of the ridge are continuous with each other in the front-rear direction.

2. The shoe sole according to claim 1, wherein: an area that is anterior to the longitudinal arch includes the forefoot portion; an area that is posterior to the longitudinal arch includes the rear foot portion; and an area where the longitudinal arch is provided includes a middle foot portion between the forefoot portion and the rear foot portion.

3. The shoe sole according to claim 2, wherein:

the upper layer is formed to be thickest in an area that is anterior to the boundary line; and the lower layer is formed to be thickest in an area that is posterior to the longitudinal arch.

4. The shoe sole according to claim 3, wherein:

the lower layer extends to a position posterior to the longitudinal arch;

the boundary line of the lower layer is arranged anterior to the longitudinal arch; and the boundary line is arranged posterior to a bent groove extending in a width direction, the bent groove being provided on the upper layer of the forefoot portion.

5. The shoe sole according to claim 2, wherein:

in the forefoot portion, an upper surface of one part of the outsole is attached to the lower surface of the lower layer and the lower surface of the upper layer so that the upper surface of the one part of the outsole bridges between an anterior edge region of the lower layer and an area of the upper layer that is adjacent to the anterior edge region of the lower layer.

6. The shoe sole according to claim 2, wherein:

directly above the longitudinal arch, a joint surface between the upper layer and the lower layer forms a downward slope that slopes down in an anterior direction.

7. The shoe sole according to claim 2, wherein: the boundary line extends in a diagonally posterior direction from the medial portion toward the lateral portion.

8. The shoe sole according to claim 1, wherein:

the boundary line is configured so as to be arranged posterior to an anterior end of a ball of a foot of a wearer.

9. The shoe sole according to claim 1, wherein:

in the primary tread portion, the lower layer is configured not to be arranged directly under a metatarsal phalangeal joint of a foot of a wearer, whereas the upper layer and the outsole are configured to be arranged directly under the metatarsal phalangeal joint of the foot of the wearer.

10. The shoe sole according to claim 1, wherein:

the boundary line extends to a medial-side edge of the midsole in the posterior end portion of the forefoot portion, and extends to a lateral-side edge of the midsole in the posterior end portion of the forefoot portion.

11. The shoe sole according to claim 1, wherein:

the primary tread portion of the upper layer includes a first lower surface being on a medial side relative to the first longitudinal groove and a second lower surface being on a lateral side relative to the first longitudinal groove, the first lower surface and the second lower surface being not covered by the lower layer, the first lower surface and the second lower surface each forming a lower surface of the midsole, the first lower surface and the second lower surface being attached to the upper surface of the outsole.

12. The shoe sole according to claim 11, wherein:

the primary tread portion includes a first primary portion between the first longitudinal groove and the medial edge portion, and a second primary portion between the first longitudinal groove and the lateral edge portion.

13. The shoe sole according to claim 12, wherein:

a size of the first primary portion in a width direction is larger than that of the second primary portion.

14. The shoe sole according to claim 1, wherein:

an area that is anterior to the longitudinal arch includes the forefoot portion;

an area that is posterior to the longitudinal arch includes the rear foot portion; and an area where the longitudinal arch is provided includes a middle foot portion between the forefoot portion and the rear foot portion.

15. The shoe sole according to claim 14, wherein:

the lower layer protrudes downward of the ridge in each of the medial portion and the lateral portion; and the medial portion of the lower layer, the lateral portion of the lower layer and a lower surface of the ridge together form a second longitudinal groove extending in the front-rear direction.

16. The shoe sole according to claim 15, wherein:

a depressed portion with a bottom surface extending in the front-rear direction is formed on the lower layer posterior to the slit in the lower layer, and a posterior end of the second longitudinal groove and an anterior end of the depressed portion are continuous with each other in the front-rear direction.

17. The shoe sole according to claim 15, wherein:

the first longitudinal groove extending in the front-rear direction is formed on the lower surface of the upper layer anterior to the slit, and a posterior end of the first longitudinal groove and an anterior end of the second longitudinal groove are continuous with each other in the front-rear direction.

* * * * *